US010898751B2

(12) United States Patent
Siu

(10) Patent No.: US 10,898,751 B2
(45) Date of Patent: Jan. 26, 2021

(54) STRAP-BASED EXERCISE SYSTEM

(71) Applicant: Auster Enterprises Limited, Hong Kong (CN)

(72) Inventor: Andrew S. P. Siu, Hong Kong (CN)

(73) Assignee: Auster Enterprises Limited, N.T. (HK)

( * ) Notice: Subject to any disclaimer, the term of this patent is extended or adjusted under 35 U.S.C. 154(b) by 0 days.

(21) Appl. No.: 15/921,611

(22) Filed: Mar. 14, 2018

(65) Prior Publication Data

US 2018/0318631 A1 Nov. 8, 2018

(30) Foreign Application Priority Data

May 5, 2017 (TW) ..... 106206395 U
May 5, 2017 (TW) ..... 106206396 U
May 5, 2017 (TW) ..... 106206397 U

(51) Int. Cl.

| | |
|---|---|
| ***A63B 21/055*** | (2006.01) |
| ***A63B 21/16*** | (2006.01) |
| ***A63B 21/04*** | (2006.01) |
| ***A63B 21/068*** | (2006.01) |
| ***A63B 21/00*** | (2006.01) |
| ***A63B 21/002*** | (2006.01) |

(Continued)

(52) U.S. Cl.

CPC ..... *A63B 21/0557* (2013.01); *A63B 21/0023* (2013.01); *A63B 21/0442* (2013.01); *A63B 21/068* (2013.01); *A63B 21/16* (2013.01); *A63B 21/169* (2015.10); *A63B 21/1663* (2013.01); *A63B 21/4007* (2015.10); *A63B 21/4035* (2015.10); *A63B 21/0555* (2013.01); *A63B 29/024* (2013.01); *A63B 71/02* (2013.01); *A63B 2071/0072* (2013.01)

(58) Field of Classification Search

CPC .... A63B 21/002–0023; A63B 21/0557; A63B 21/068; A63B 21/1618; A63B 21/1663; Y10T 24/3493; Y10T 24/4755; F16B 45/06

See application file for complete search history.

(56) References Cited

U.S. PATENT DOCUMENTS 6,336,260 B1 * 1/2002 Mauthner ..... F16B 45/02 24/376
7,044,896 B2 5/2006 Hetrick (Continued)

FOREIGN PATENT DOCUMENTS

CN 101325987 A 12/2008
CN 202044695 U 11/2011

(Continued)

*Primary Examiner* — Jennifer Robertson
(74) *Attorney, Agent, or Firm* — Owens Law Firm, PC

(57) ABSTRACT

The invention is a strap-based suspension exercise system that includes a main strap that is attached to a fixed or stationary object to anchor the exercise system and exercise straps that are used to perform a variety of exercises. Different main straps are provided that enable anchoring the exercise system virtually anywhere. The exercise straps, which may be inelastic or elastic are attached to the main strap using a uniquely designed buckle and include a safety strap. Various optional equipment, such as a foot hammock, a wrist or foot strap, additional handles, exercise straps with gym rings, and a vest worn by the user are provided.

7 Claims, 31 Drawing Sheets

(51) Int. Cl.

| | |
|---|---|
| ***A63B 71/00*** | (2006.01) |
| ***A63B 29/02*** | (2006.01) |
| ***A63B 71/02*** | (2006.01) |

(56) References Cited

U.S. PATENT DOCUMENTS

| | | | | |
|---|---|---|---|---|
| 7,090,622 | B2 | 8/2006 | Hetrick | |
| 7,762,932 | B2 | 7/2010 | Hetrick | |
| 7,785,244 | B2 | 8/2010 | Hetrick | |
| 7,806,814 | B2 | 10/2010 | Hetrick | |
| 8,083,653 | B2 | 12/2011 | Hetrick | |
| 8,152,704 | B2 | 4/2012 | Brice | |
| 8,840,532 | B2 | 9/2014 | Hetrick | |
| 8,979,716 | B1 * | 3/2015 | Rawlins | A63B 21/0442 482/91 |
| 9,155,931 | B2 | 10/2015 | Hetrick | |
| 9,433,258 | B2 | 9/2016 | Hetrick | |
| 2013/0178345 | A1 * | 7/2013 | Wu | A63B 21/068 482/139 |
| 2015/0343253 | A1 * | 12/2015 | Nikkaran | A63B 21/068 482/96 |

FOREIGN PATENT DOCUMENTS

| | | | |
|---|---|---|---|
| CN | 202069053 | U | 12/2011 |
| CN | 103845851 | A | 6/2014 |
| WO | WO2015195168 | A1 | 12/2015 |

* cited by examiner

STRAP-BASED EXERCISE SYSTEM

BACKGROUND OF THE INVENTION

Field of the Invention

The invention, including its various embodiments, relates to an exercise system. In particular, the invention, including its various embodiments, relates to a suspension exercise system that can be anchored to a stationary body and includes a pair of exercise straps and other optional attachments that are used by a person to exercise.

Description of Related Art

Personal exercise equipment for use in resistance training is abundant. For example, strap-based systems exist that allow a user to exercise. However, improvements in the design and quality of such systems is still needed. For example, such strap systems need to provide a mechanism to allow for the system to be properly anchored during use. Additionally, such strap systems need to provide a robust mechanism for attachment of the straps that also makes attachment and detachment of the straps convenient. Further, the designs of the straps themselves need to provide straps that can be easily and safely used. For example, the design should provide for length adjustment and safety in the event of failure of any mechanism used for the length adjustment. The design should also minimize or avoid uncontrolled bouncing or unsafe contact of the straps with a user. Further still, such strap systems should be design to accommodate a variety of optional attachments that can be used for various and different types of exercise. Therefore, there is a need for a strap-based personal exercise system having a design and various features to provide for the above needs.

BRIEF SUMMARY OF THE INVENTION

In general, the present invention is directed to a strap-based suspension exercise system having multiple components. The exercise system provides components for anchoring the system to a fixed or stationary object and exercise straps that are held by a user to perform a variety of exercises, along with a variety of optional components for performing additional exercises. The exercise system has different exercise straps and multiple optional components that when attached provide the ability to conduct various other exercises. Accordingly, the exercise system provides a robust strap-based exercise system that can be used virtually anywhere for perform a wide variety of exercises.

Generally, the exercise system includes a main strap that is attached to a fixed or stationary object to anchor the exercise system for use. The main strap can take a variety of forms. In one embodiment, the main strap is attached at one end to a fixed or stationary object, such as a door, and at an opposite end to a buckle that conveniently allows for the reversible attachment of various exercise straps and other optional equipment. In another embodiment, one end of the main strap is connected to a location along the main strap, thereby forming a loop that is placed around a fixed or stationary object to anchor the system. The exercise system also includes an anchor that can be attached to a fixed or stationary object and used in conjunction with the main strap.

The exercise straps are attached to the main strap at one end and are engaged or held by a user at an opposite end for performing a variety of exercises. The exercise straps can be inelastic or elastic straps. The inelastic straps, which are adjustable in length, allow a user to exercise by moving the user's body essentially against a fixed strap thereby using the user's body's own resistance, whereas the elastic strap allows a user to pull on the resistance provided by the elastic strap itself. The elastic straps also provide loops for connection of optional equipment, such as different shaped handles, to the elastic straps themselves. Exercise straps containing gym rings instead of handles are also part of the exercise system and provide for yet additional types of exercises. A protective sleeve having a soft surface can be attached to various portions of the exercise straps to minimize irritation to a user's skin caused by any contact between the user's skin and that portion of the exercise strap during use or exercise.

The exercise system provides various optional equipment that can be attached to the exercise system for performing a variety of other exercises. For example, a strap that provides a hammock for a user's foot can be attached to the end of the inelastic exercise strap for receipt of the user's foot to perform exercises using the foot. In some embodiments, this strap makes use of the existing handle on the inelastic exercise strap to support the user's foot, such as the bottom arch of the user's foot. A wrist strap, which may also be used as a foot strap, can be attached to the elastic exercise straps to allow exercise using a user's wrist or foot. A vest is also provided that can be worn by a user and attached to the elastic exercise straps at various points on the vest.

In one embodiment, the invention provides an exercise system including a main strap having a length, a first end configured for attachment to a stationary object, and an opposite second end configured to attachment to a first location along the length of the first strap, thereby forming a loop upon attachment to the first location; a buckle attached to the loop of the main strap and defining two separate openings; a pair of exercise straps, each having a first end configured for attachment to one of the two separate openings of the buckle and a second end opposite the first end; and a pair of handles, each attached to one of the second ends of the exercise straps.

In another embodiment, the invention provides an exercise system including a main strap having a length and a first end configured for attachment to a first location along the length of the first strap, thereby forming a loop sufficient to encompass a stationary object upon attachment to the first location, and a second end opposite the first end; a buckle attached to the second end of the main strap and having two separate openings; a pair of exercise straps, each having a first end configured for attachment to one of the two separate openings of the buckle and a second end opposite the first end; and a pair of handles, each attached to one of the second ends of the exercise straps.

DETAILED DESCRIPTION OF THE INVENTION

Figure 1:
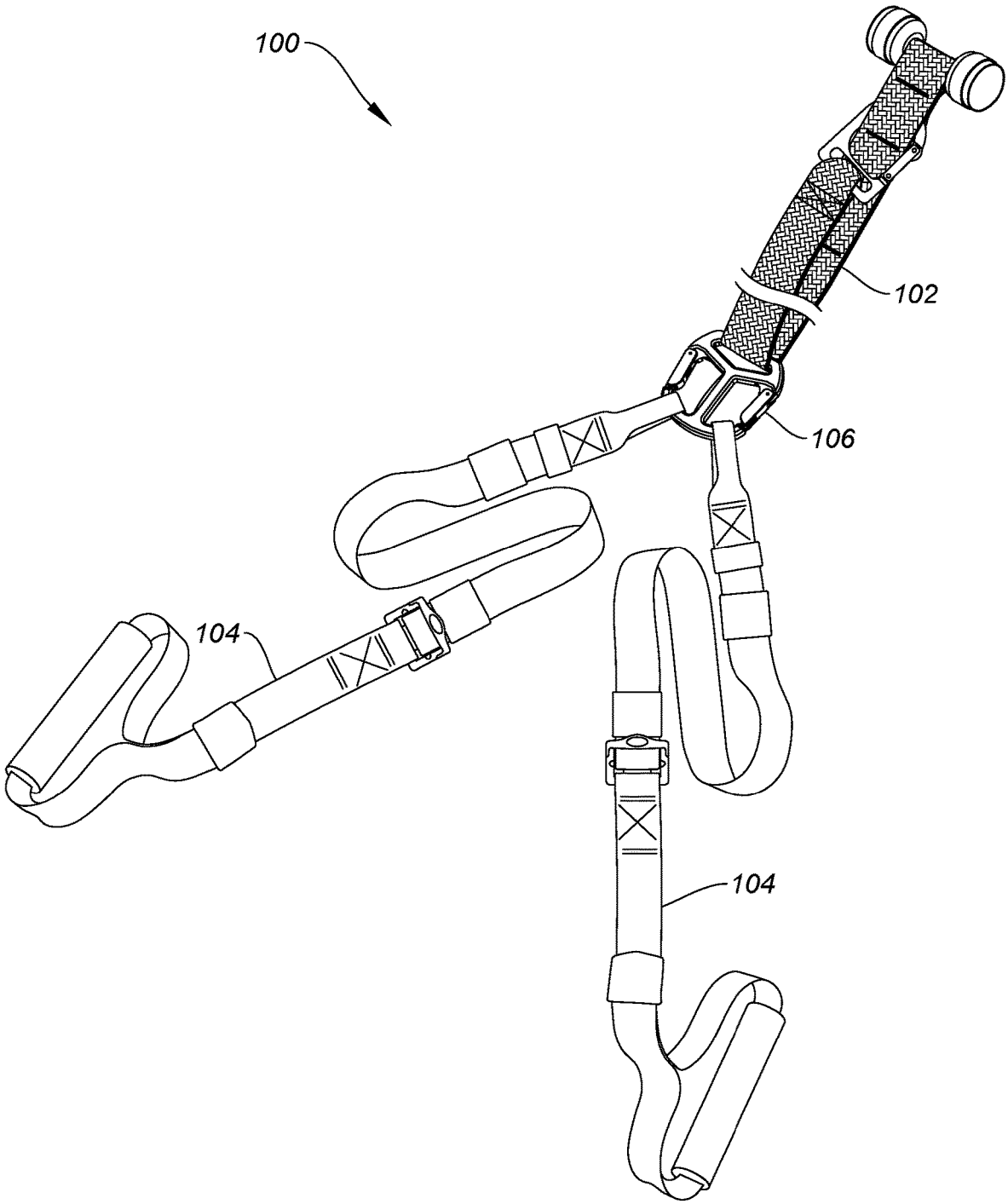
FIG. 1 is a perspective view of an exercise system according to one embodiment of the invention.

The present invention is more fully described below with reference to the accompanying drawings. While the present invention will be described in conjunction with particular embodiments, such should be viewed as examples and should not be viewed as limiting or as setting forth the only embodiments of the invention. Rather, the present invention includes various embodiments or forms and various related aspects or features and uses, as well as alternatives, modifications, and equivalents within the spirit and scope of the invention and the claims. Further, the use of the terms "invention," "present invention," "embodiment," and similar terms throughout this description are used broadly and are not intended to mean that the invention requires, or is limited to, any particular embodiment or aspect being described or that such description is the only manner in which the invention may be made or used.

In general, the present invention is directed to a strap-based suspension exercise system having multiple components. The exercise system provides components for anchoring the system to a fixed or stationary object and exercise straps that are held by a user to perform a variety of exercises along with a variety of optional components for performing additional exercises. The system has different exercise straps and multiple optional components that when attached provide the ability to conduct various other exercises. Accordingly, the exercise system provides a robust strap-based exercise system that can be used virtually anywhere for perform a wide variety of exercises.

Generally, the exercise system includes a main strap that is attached to a fixed or stationary object to anchor the exercise system for use. The main strap can take a variety of forms. In one embodiment, the main strap is attached at one end to a fixed or stationary object, such as a door, and at an opposite end to a buckle that conveniently allows for the reversible attachment of various exercise straps and other optional equipment. In another embodiment, one end of the main strap is connected to a location along the main strap, thereby forming a loop that is placed around a fixed or stationary object to anchor the system. The exercise system also includes an anchor that can be attached to a fixed or stationary object and used in conjunction with the main strap.

The exercise straps are attached to the main strap at one end and are engaged or held by a user at an opposite end for performing a variety of exercises. The exercise straps can be inelastic or elastic straps. The inelastic straps, which are adjustable in length, allow a user to exercise by moving the user's body essentially against a fixed strap thereby using the user's body's own resistance, whereas the elastic strap allows a user to pull on the resistance provided by the elastic strap itself. The elastic straps also provide loops for connection of optional equipment, such as different shaped handles, to the elastic straps themselves. Exercise straps containing gym rings instead of handles are also part of the exercise system and provide for yet additional types of exercises. A protective sleeve having a soft surface can be attached to various portions of the exercise straps to minimize irritation to a user's skin caused by any contact between the user's skin and that portion of the exercise strap during use or exercise.

The exercise system provides various optional equipment that can be attached to the exercise system for performing a variety of other exercises. For example, a strap that provides a hammock for a user's foot can be attached to the end of the inelastic exercise strap for receipt of the user's foot to perform exercises using the foot. In some embodiments, this strap makes use of the existing handle on the inelastic exercise strap to support the user's foot, such as the bottom arch of the user's foot. A wrist strap, which may also be used as a foot strap, can be attached to the elastic exercise straps to allow exercise using a user's wrist or foot. A vest is also provided that can be worn by a user and attached to the elastic exercise straps at various points on the vest.

Following is a description of the various components of the exercise system in conjunction with the various figures. As noted, it should be appreciated that the following description is intended to illustrate the various components of the exercise system and is not intended to be limited to any particular design or detail. Accordingly, the invention is intended to encompass variations in the design of the components of the exercise system as described herein.

FIG. 1 is a perspective view of an exercise system according to one embodiment of the invention. The exercise system 100 is a strap-based exercise system that provides a main strap 102 for attachment to a stationary object and for attachment to various exercise straps 104 and other attachments that are engaged by a user during exercise. The main strap 102 is used to anchor the system to a stationary or fixed object that will support whatever force is exerted by a user on the system through the use of the exercise straps 104 or other attachments. The main strap 102 is attached to the exercise straps 104 through the use of a main buckle 106. Each of these components of the exercise system 100 are described in more detail following.

Figure 2:
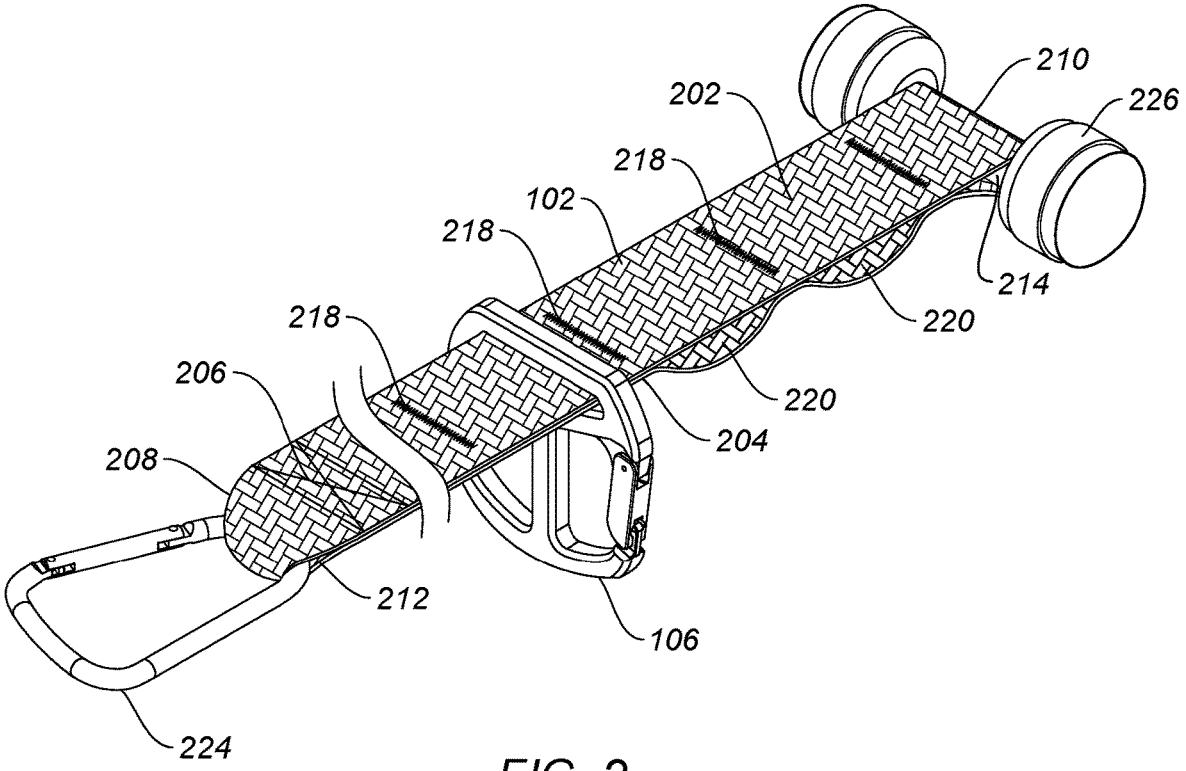
FIG. 2 is a perspective view of a main strap of the exercise system according to one embodiment of the invention.

FIG. 2 is a perspective view of a main strap of the exercise system according to one embodiment of the invention. The main strap 102 is an inelastic strap that can be made from any material sufficient to withstand the force to which it will be subjected during use. In one embodiment, the main strap 102 is made from an inelastic nylon material. It should be appreciated that in one embodiment, the main strap 102 is a single length of strap folded on top of itself to form a top strap portion 202 and a bottom strap portion 204. In this configuration, the two ends of the main strap 102 are connected where they overlap each other. In one embodiment, the location 206 at which the two ends overlap is stitched in a manner to secure the ends together and sufficient to withstand any force applied to the main strap 102 that would otherwise cause the two ends to separate. It should be appreciated, however, that each end may also be separately folded back onto the strap and attached at a point along the strap separate from the attachment of the other end in a similar manner. By virtue of the strap being folded on top of itself, at each end 208, 210 of the main strap 102, loops 212, 214 are formed. In addition, stitching 218 at various points along the length of the main strap 102 may be used to both secure the top strap portion 202 and the bottom strap portion 204 to each other and to form additional loops 220 along the length of the bottom strap portion 204 of the main strap 102 by allowing for a longer length of the bottom strap portion 204 per length of the top strap portion 202. It should be appreciated that the overall length of the main strap 102 can be made to any length and that the number of stitchings 218 and, accordingly, the number of loops 220 along the bottom side portion 204, can also be varied.

Various components are attached to the main strap 102. The main buckle 106 is attached to the main strap 102 such that it is configured to freely slide along the length of the main strap 102. This main buckle 106 is used to connect the exercise straps that are engaged by the user during exercise and is described in more detail below. A carabiner 224 or similar device is connected through one loop 212 at one end 208 of the main strap 102. This carabiner 224 is discussed further below in connection with FIG. 3. A device 226 or anchor for engaging a stationary object, such as a closed door, and for securing the main strap 102 to the stationary object, thereby preventing the main strap 102 from being pulled away from the stationary object, is attached to the loop 214 at the other end 210 of the main strap 102. This anchor 226 is also discussed further below.

Figure 3:
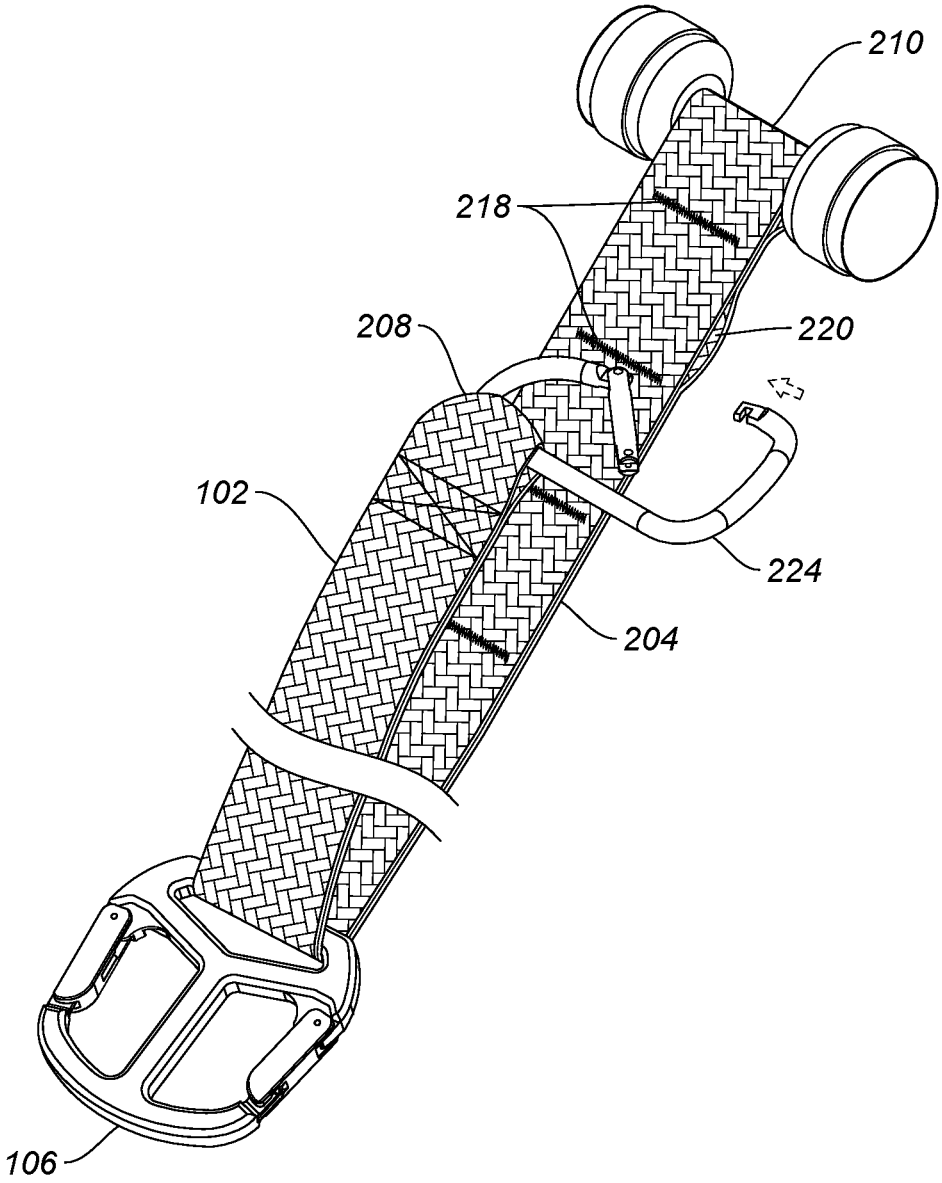
FIG. 3 is another perspective view of the main strap of the exercise system of FIG. 2 according to one embodiment of the invention.

FIG. 3 is another perspective view of the main strap of the exercise system of FIG. 2 according to one embodiment of the invention. The carabiner 224 connected at one end 208 of the main strap 102 is used to secure that end 208 of the main strap 102 to one of the loops 220 along the bottom side portion 204 of the main strap 102. By securing the end 208 of the main strap 102 to one of the loops 220 along the bottom side portion 204 of the main strap 102, the main strap 102 forms a loop. The main buckle 106 now can freely slide along this loop formed by the attachment of the end 208 of the main strap 102 to one of the loops 220 along the bottom side portion 204 of the main strap 102. However, it should be appreciated that the main buckle 106 is now secured to the main strap 102 and can be pulled in a direction away from the anchor 226 for engaging a stationary object or the opposite end 210 of the main strap 102 without being disconnected from the main strap 102. In other words, by securing the end 208 of the main strap 102 to one of the loops 220 along the bottom side portion 204 of the main strap 102, the main buckle 106 is now secured to the main strap 102. Once the anchor 226 for engaging a stationary object is secured to the stationary object, the main strap 102 and, axiomatically, the main buckle 106, are also secured to the stationary object. Accordingly, as described further below, attachment of the straps engaged by the user to this main buckle 106 effectively secures these straps to the stationary object as well to allow the user to exercise.

It should be appreciated that the end 208 of the main strap 102 can be secured to any one of the loops 220 along the bottom side portion 204 of the main strap using the carabiner 224. The selection of which loop 220 to use is dependent upon the desired length of the main strap 102 during use. For example, if the main strap 102 is secured to a stationary object that is relatively high, then one of the loops 220 located further from the anchor 226 for engaging a stationary object may be used. In this way, the distance from the anchor 226 to the main buckle 106 would be greater to allow for the straps to be engaged by the user at a distance further from the stationary object. Conversely, if a relatively shorter main strap 102 were desirable, the loop 220 closer to the anchor 226 for engaging a stationary object may be used, thereby providing a relatively shorter main strap 102 during use. It should also be appreciated that while a carabiner 224 is shown, any device that allows for the connection of the end 208 of the main strap 102 to one of the loops 220 along the bottom side portion 204 of the main strap 102 may be used. In some embodiments, this device provides the ability to easily connect and disconnect the end 208 of the main strap 102 to and from one of the loops 220 along the bottom side portion 204 of the main strap 102. In some embodiments, this device provides sufficient strength to avoid the end 208 of the main strap 102 disconnecting from a given loop 220 along the bottom side portion 204 of the main strap 102, particularly during use of the exercise system.

Figure 4:
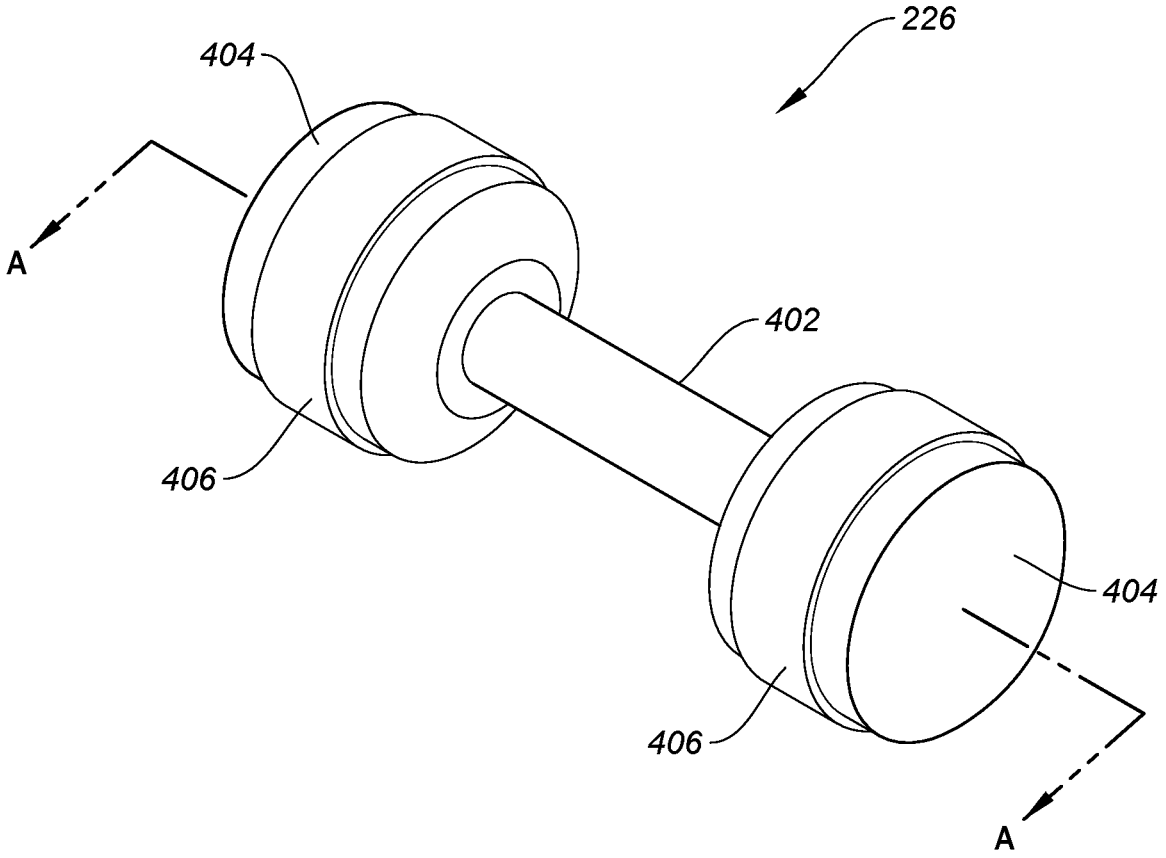
FIG. 4 is a perspective view of the device for securing the main strap of FIG. 2 to a stationary object according to one embodiment of the invention.

FIG. 4 is a perspective view of the device for securing the main strap of FIG. 2 to a stationary object according to one embodiment of the invention. The anchor 226, which is attached to one end 210 of the main strap 102 (see FIG. 2), is used to secure the main strap 102 to a stationary object, such as a door, as described further below. The anchor 226 includes a shaft body 402 with two bodies 404, one attached to each end of the shaft body 402. The shaft body 402 is a cylindrical body that is attached at opposite ends to one of the two bodies 404, which are also cylindrical shaped bodies. In one embodiment, the cylindrical shaped bodies 404 attached to each end of the shaft body 402 have a diameter that is larger than the diameter of the cylindrical shaft body 402 and a length along the cylinder that is smaller than the length of the cylindrical shaft body 402. A non-slip circular pad 406 is disposed on the surface of each of the bodies 404 and, in some embodiments, is disposed around the entire perimeter of the body 404 but may not be disposed along the entire cylinder length of the body 404. It should be appreciated that the thickness of the non-slip pads 406 is sufficient to extend the outside surface of the non-slip pad 406 above the surface of the bodies 404. It should be appreciated that the non-slip pads 406 may be used to minimize or prevent the anchor 226 from moving during use along the surface to which it is adjacent, such as a door or door frame. In some embodiments, however, the non-slip pads 406 may be designed to avoid any contact between the exercise system and the stationary object to which the anchor 226 is placed against. In other words, the non-slip pads 406 may be used to avoid scratching or marring the stationary object, such as the door or door frame.

Figure 5:
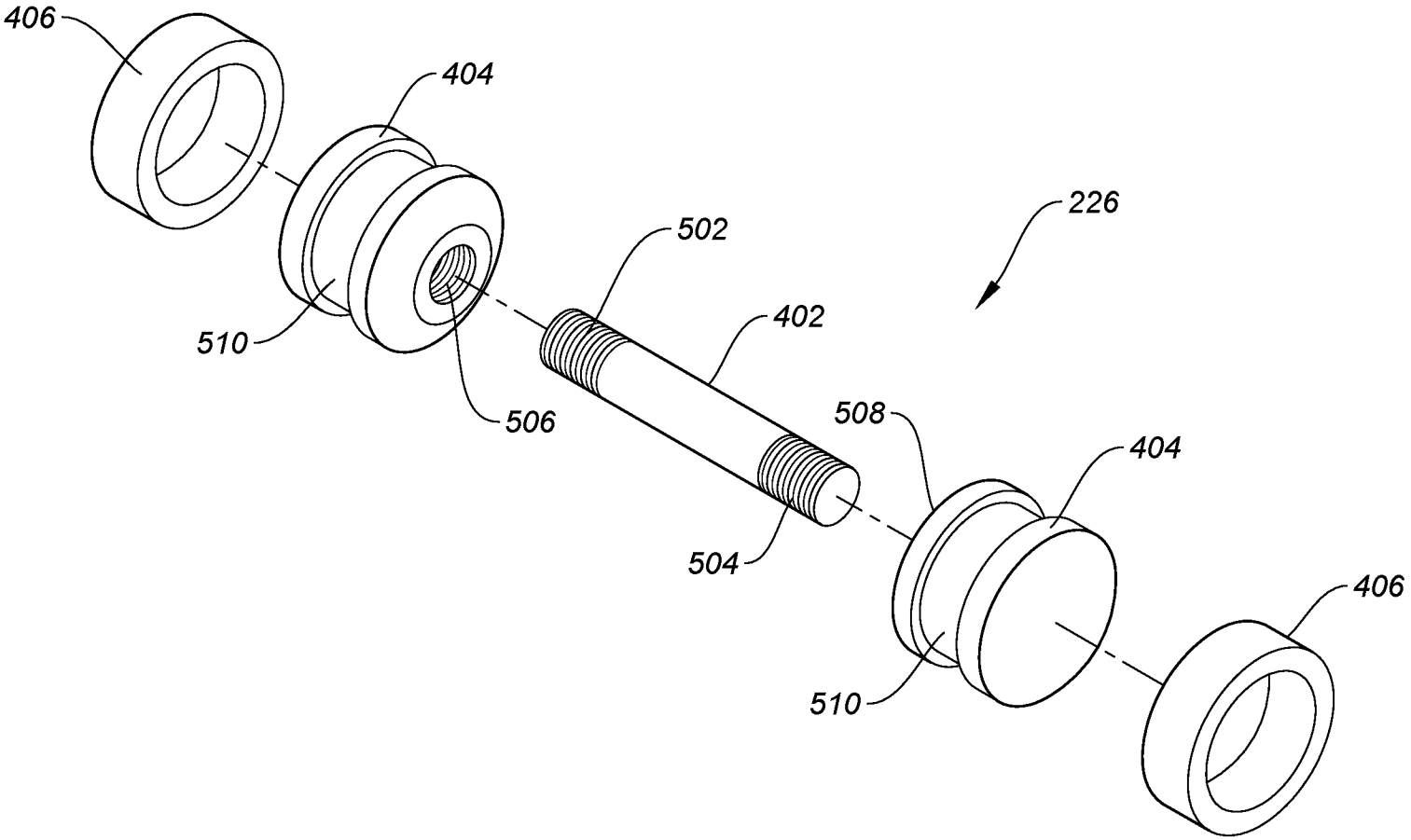
FIG. 5 is an exploded view of the device of FIG. 4 according to one embodiment of the invention.

FIG. 5 is an exploded view of the device of FIG. 4 according to one embodiment of the invention. As shown, the shaft body 402 of the anchor 226 is threaded at each end 502, 504. Accordingly, each body 404 that is attached to each end of the shaft body 402 has a corresponding female thread 506, 508 to facilitate screwing each body 404 onto each of the ends of the shaft body 402. It should be appreciated that the ability to remove one of the bodies 404 from the end of the shaft body 402 permits the anchor 226 to be attached and removed from the end 201 of the main strap 102. In other words, by removing one of the bodies 404 from the end of the shaft body 402, the shaft may be inserted through the loop 214 at the end 210 of the main strap 102 (see FIG. 2) and thereafter that body 404 may be secured to its respective end of the shaft body 402. It should be appreciated that the bodies 404 attached to each end of the shaft body 402 are similar in size and weight to each other and in some embodiments are identical in size and weight. In some embodiments, bodies 404 are generally right cylindrical bodies (although the ends or edges of the cylinders may be rounded) having a center axis collinear with that of the shaft body 402 but having a diameter that is larger than the diameter of the shaft body 402. It should further be appreciated that the overall size of the bodies 404 at the ends of the shaft body 402 are sized to prevent the loop 214 of the main strap 102 from passing over the bodies 404. Due to the larger size of the bodies 404, the main strap 102 would be secured between these two bodies 404. Alternatively, the size of the loop 214 can be made small enough relative to the size of the bodies 404 to accomplish the same result. It should also be appreciated that in some embodiments, the shaft body 402 and the bodies 404 attached to each end of the shaft body 402 are made of a metal having a density that provides significant weight to the overall anchor 226 to add to its stability to function during use. It should also be appreciated that the length of the shaft body 402 should be sufficient to secure each of the bodies 404 attached to its ends and having a sufficient length exposed between the bodies 404 to accommodate the width of the main strap 102. In some embodiments, the length exposed between the bodies 404 is approximately the same or only slightly greater than the width of the main strap 102 to minimize the main strap 102 from sliding along the shaft body 402 or between the bodies 404.

It should be appreciated that the shaft body 402 may be a solid shaft or rod and can be made of any suitable material including any suitable metal. Similarly, the bodies 404 attached to each of the ends of the shaft body 402 may be solid and can be made of any suitable material including any suitable metal, such as the same metal used for the shaft body 402. In some embodiments, the metal may be a smoothly polished metal. It should be appreciated, however, that the material used to construct the shaft body 402 and the bodies 404 attached to each of the ends of the shaft body 402 should be of sufficient strength to withhold the force exerted on the exercise system by the user.

The non-slip pads 406 are circular bands and are secured around the bodies 404 attached to each of the ends of the shaft body 402 by the use of a friction fit within a circular groove 510 that extends around the entire perimeter or outside of each of the bodies 404. The non-slip pads 406 have a diameter that when disposed within these grooves 510 provides a sufficiently tight fit around the body 404. Again, it should be appreciated that the thickness of the non-slip pads 406 is sufficient to extend the surface of the non-slip pad 406 above the surface of the bodies 404. In some embodiments, the non-slip pads 406 are made of a plastic, silicon, or rubber material; however, any material that provides a non-slip function when in contact with another surface, can be used. In some embodiments, the non-slip pads may be coated with or impregnated with a plurality of particles that would serve to prevent skidding of non-slip pads when in contact with a surface. In some embodiments, the outer surfaces of the non-slip pads are provided with a plurality of bumps, depressions, stripes, wavy lines, anilox lines, or letters or numbers that are raised or depressed, or any combination of the foregoing, to provide a non-slip function. In some embodiments, the material used for the non-slip pads 406 is selected to simply provide a cushion between the anchor 226 and the stationary object against which it is resting to avoid scratching, marring, or denting the surface of the stationary object, such as a door or door frame.

Figure 6:
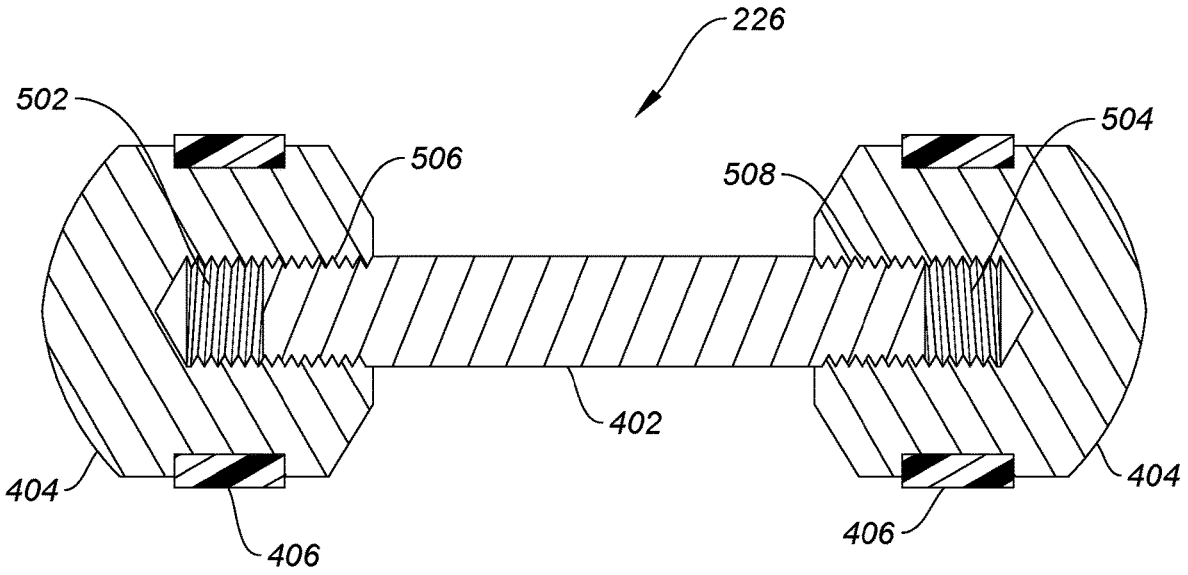
FIG. 6 is a cross-sectional view of the device of FIG. 2 taken along line A-A of FIG. 4 according to one embodiment of the invention.

FIG. 6 is a cross-sectional view of the device of FIG. 2 taken along line A-A of FIG. 4 according to one embodiment of the invention. As shown, the shaft body 402 is screwed into the bodies 404 attached to each of its ends using the threads 502/506, 504/508. It should be appreciated, however, that only one end of the shaft body 402 may contain threads with corresponding threads on a bore of one of the bodies 404 to be attached to that end of the shaft body 402. In this embodiment, the shaft body 402 may be integrally formed with the other body 404 attached to non-threaded end of the shaft body 402. Also, it should be appreciated the ends of the bodies 404, i.e., the ends of the cylinders, may be contoured or rounded as shown.

Figure 7:
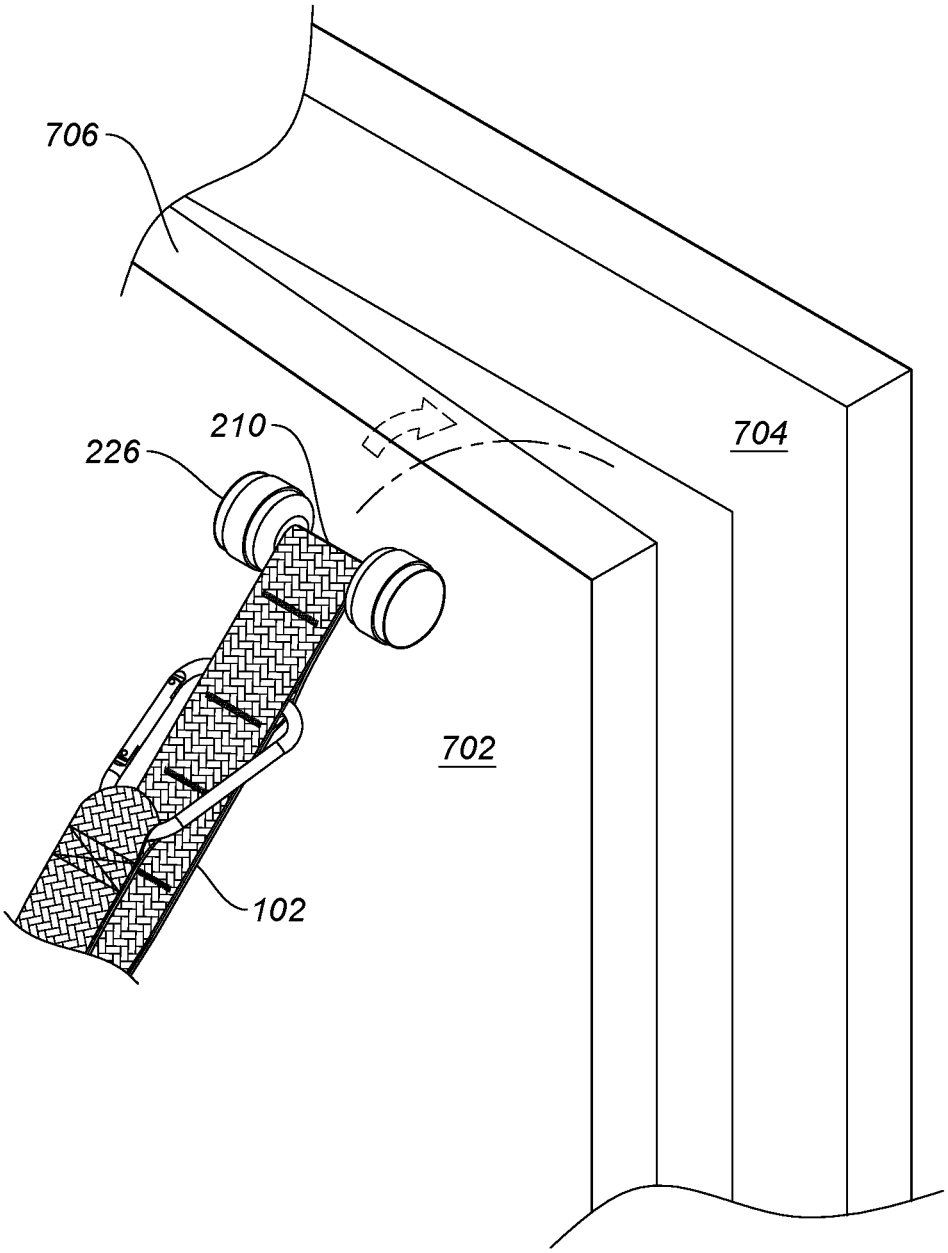
FIG. 7 illustrates the placement of the device for securing the main strap of FIG. 2 to a door and door frame when the door is in an open position according to one embodiment.

FIG. 7 illustrates the placement of the device for securing the main strap of FIG. 2 to a door and door frame when the door is in an open position according to one embodiment. In use, the exercise system 100 must first be secured to a fixed or stationary object to allow a user to engage the straps and pull on them to exercise without the opposite end of the system moving. The anchor 226 for engaging a stationary object, such as a closed door, and for securing the main strap 102 to the stationary object, is what provides this secure connection. As shown, the anchor 226 at the end 210 of the main strap 102 is placed over the top 706 of a door 702 that has been opened relative to its door frame 704. The door 702 is then closed, which leaves the anchor 226 on one side of the door 702 and the main strap 102 and remaining portions of the exercise system 100 on the opposite side of the door 702. This prevents the anchor 226 being pulled back over the top of the door 702 when the main strap 102 is pulled during use (i.e., by the user pulling on the straps attached to the main strap 102) on the opposite side of the door 702.

Figure 8:
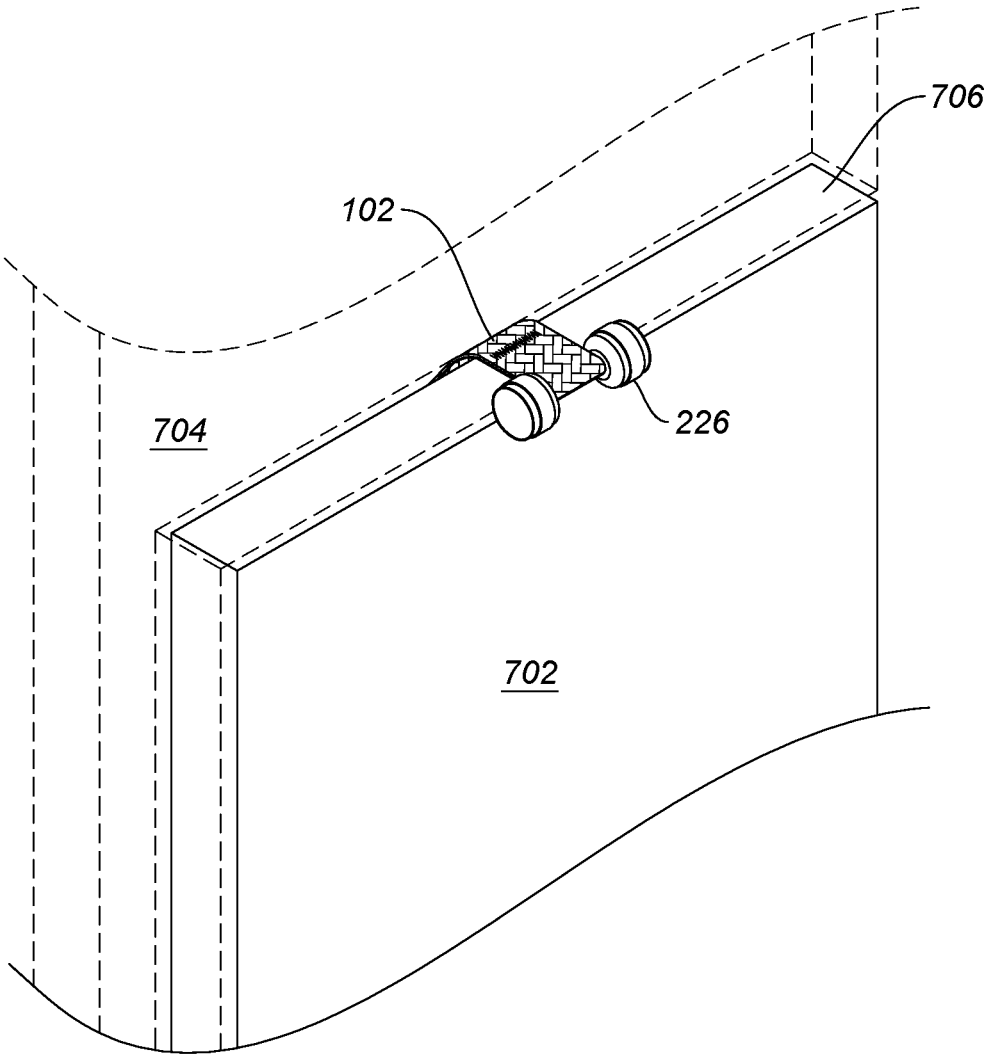
FIG. 8 illustrates the placement of the device for securing the main strap of FIG. 2 to a door and door frame when the door is in an open position according to one embodiment.

FIG. 8 illustrates the placement of the device for securing the main strap of FIG. 2 to a door and door frame when the door is in a closed position according to one embodiment. Once the anchor 226 has been placed over the top 706 of the door 702 and the door 702 has been closed, the anchor 226 is of sufficient size that it cannot be pulled between the top 706 of the door 702 and the door frame 704. As shown, only a portion of the main strap 102 passes from the anchor 226 and between the top 706 of the door 702 and the adjacent door frame 704 to the other side of the door 702. Accordingly, it should be appreciated that the size of the anchor 226, including the shaft body 402 and the bodies 404 attached to its ends, can be adjusted in size but simply need to be of sufficient size to avoid being pulled through any opening that exists between the top 706 of the door 702 and the adjacent door frame 704.

Figure 9:
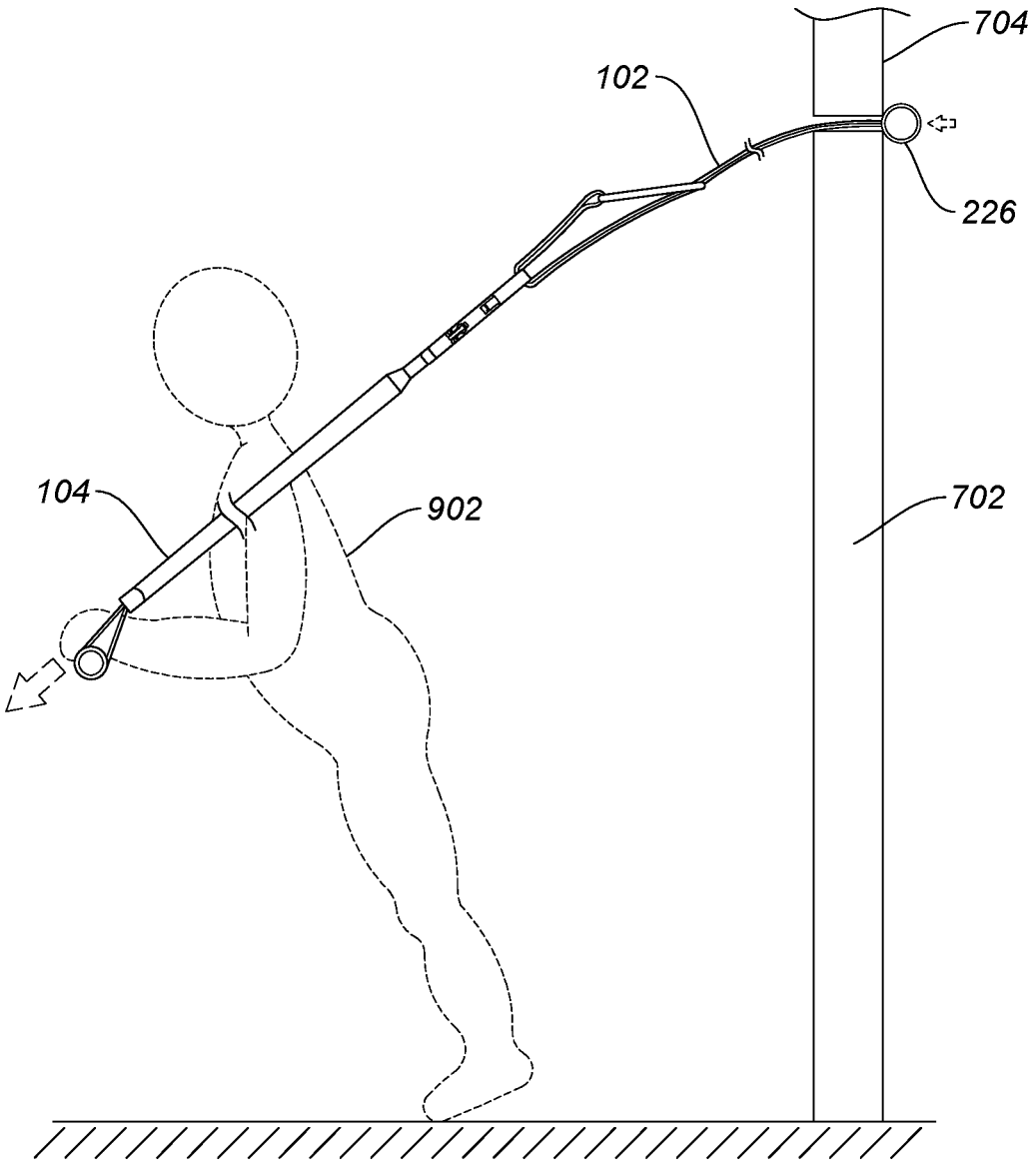
FIG. 9 illustrates a side view of placement of the device for securing the main strap of FIG. 2 to a door and door frame when the door is in a closed position and a person is using the exercise system according to one embodiment.

FIG. 9 illustrates a side view of placement of the device for securing the main strap of FIG. 2 to a door and door frame when the door is in a closed position according to one embodiment. As shown, with the door 702 closed, the anchor 226 is disposed on one side of the door 702 and the main strap 102, attached to the anchor 226, passes through the space between the top 706 of the door 702 and the adjacent surface of the door frame 704 to the opposite side of the door 702 where a user 902 engages the straps 104 attached to the main strap 102 for exercising. Is should be appreciated that the non-slip pads 406 on each of the bodies 404 attached to the ends of the shaft body 402 of the anchor 226 engage the surfaces of the door 702 and door frame 704 once the main strap 102 is pulled via the user pulling on the straps 104 attached to the main strap 102. This engagement between the non-slip pads 406 and the surfaces of the door 702 and the door frame 704 minimizes and, in some embodiments, prevents movement of the anchor 226 during use and in some embodiments minimize or prevents scratching, marring, or denting of the surface of the door 702 or door frame 704. In turn, because the length of the shaft body 402 is sized to minimize or prevent sliding of the main strap 102 along the shaft body 402, as described above, the main strap 102 similarly does not slide or move along the top of the door 702 during a user's exercise. Therefore, the anchor 226 provides a stationary anchor point for the exercise system 100 during use, which avoids the exercise system sliding, for example, along the top 706 of the door 702 during use.

It should be appreciated that the anchor 226 can be configured and sized to accommodate its use with any fixed or stationary object that provides a similar relationship as a door to a door frame. In other words, any stationary object that permits the anchor 226 to be located on one side and to only allow passage of a relatively thin strap (i.e., the main strap 102) through an opening to the other side can be used to secure the main strap 102 for use in exercising.

Figure 10:
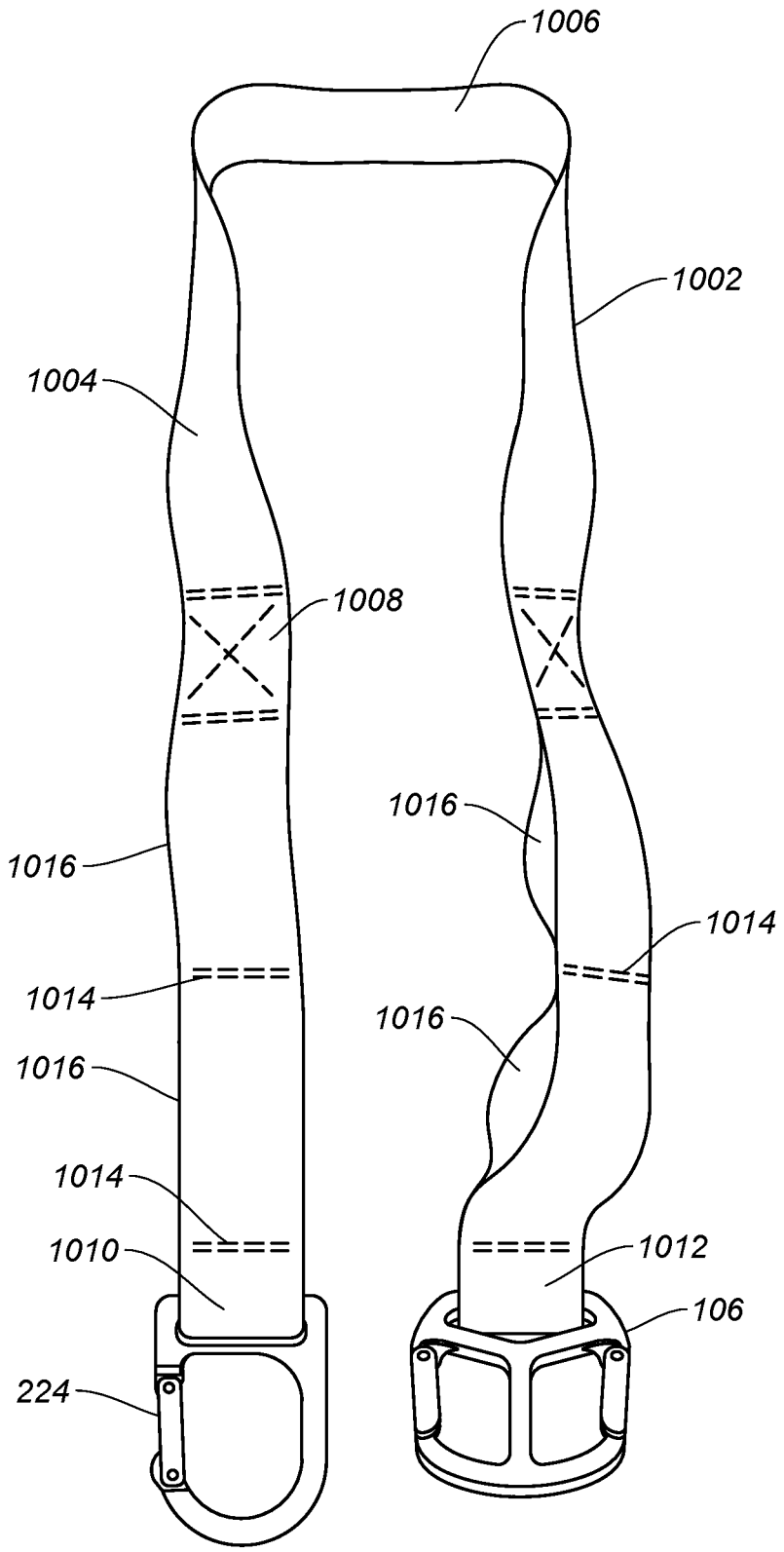
FIG. 10 is a perspective view of another main strap of the exercise system according to one embodiment of the invention.

FIG. 10 is a perspective view of another main strap of the exercise system according to one embodiment of the invention. In those situations in which a stationary object, such as a closed door, for which the anchor 226 for engaging a stationary object cannot be used, a different main strap 1002 may be used. This main strap 1002 is similar to the main strap 102 shown in FIG. 2 in that it is also an inelastic strap that can be made from any material sufficient to withstand the force to which it will be subjected during use. In one embodiment, the main strap 1002 is made from an inelastic nylon material. It should be appreciated that in one embodiment, the main strap 1002 is a single length of strap folded on top of itself to form a top strap portion 1004 and a bottom strap portion 1006. In this configuration, the two ends of the main strap 1002 are connected where they overlap. In one embodiment, the location 1008 at which the two ends overlap is stitched in a manner to secure the ends together and sufficient to withstand any force applied to the main strap 1002 that would otherwise cause separation from the main strap 1002. It should be appreciated, however, that each end may also be separately folded back onto the strap and attached at a point along the strap separate from the attachment of the other end in a similar manner. By virtue of the strap being folded on top of itself, at each end 1010, 1012 of the main strap 1002, loops are formed. In addition, stitching 1014 at various points along the length of the main strap 1002 may be used to both secure the top strap portion 1004 and the bottom strap portion 1006 to each other and to form additional loops 1016 along the length of the bottom strap portion 1006 of the main strap 1002 by allowing for a longer length of the bottom strap portion 1006 per length of the top strap portion 1004 during manufacture. It should be appreciated that the overall length of the main strap 1002 can be made to any length and that the number of stitchings 1014 and, accordingly, the number of loops 1016 along the bottom side portion 1006, can also be varied.

Similar to the main strap 102 shown in FIG. 2, various components are also attached to the main strap 1002 in this embodiment. A main buckle 106 that is the same as that described in connection with FIG. 2 is attached to the main strap 1002; however, in this embodiment, the main buckle 106 is attached to one of the loops at the end 1012 of the main strap 1002. Again, this main buckle 106 is used to connect the exercise straps that are engaged or held by the user during exercise and is described in more detail below. A carabiner 224 that is the same as that described in connection with FIG. 2 or similar device is similarly connected to the other loop at the other end 1010 of the main strap 1002.

Figure 11:
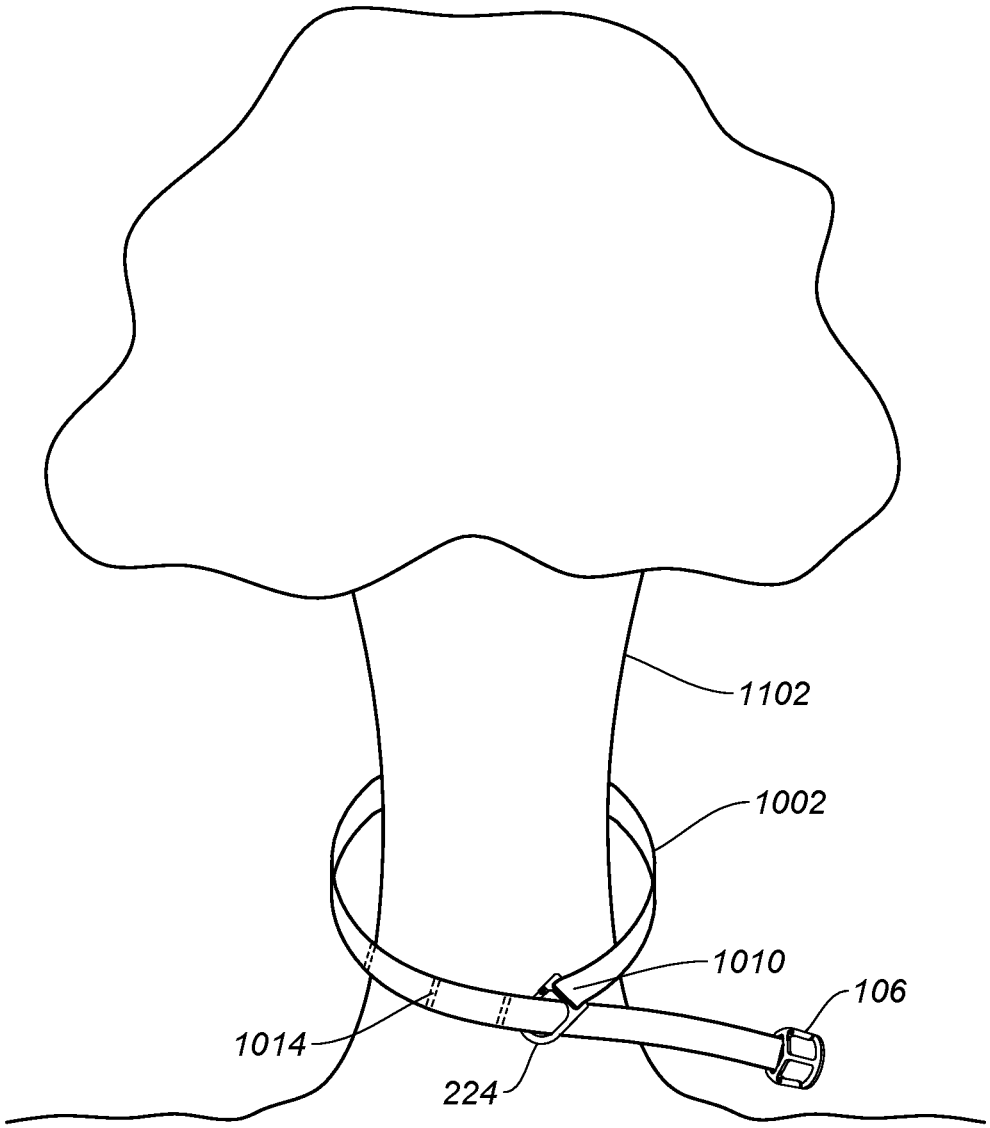
FIG. 11 is another perspective view of the main strap of FIG. 10 attached to a stationary object according to one embodiment of the invention.

FIG. 11 is another perspective view of the main strap of FIG. 10 attached to a stationary object according to one embodiment of the invention. In this embodiment, because a stationary object suitable for using the anchor 226 for attaching to a stationary object such as a door is not available, the stationary object may be a tree 1102 or any other stationary object that allows for the main strap 1002 to be wrapped around the object. Depending upon the circumference of the stationary object, such as the tree 1102, the carabiner 224 can be attached to an appropriate loop 1016 formed along the length of the main strap 1002 by the placement of various stitchings 1014. The appropriate loop 1016 is one that once the end 1010 of the main strap 1002 is secured to a given loop 1016 by the carabiner 224, the main strap 1002 is secured, for example by a tight fit, around the stationary object, in this case the tree 1102. Once secured, the user can utilize the same straps 104 that are attached to the main buckle 106 for exercising.

Figure 12A:
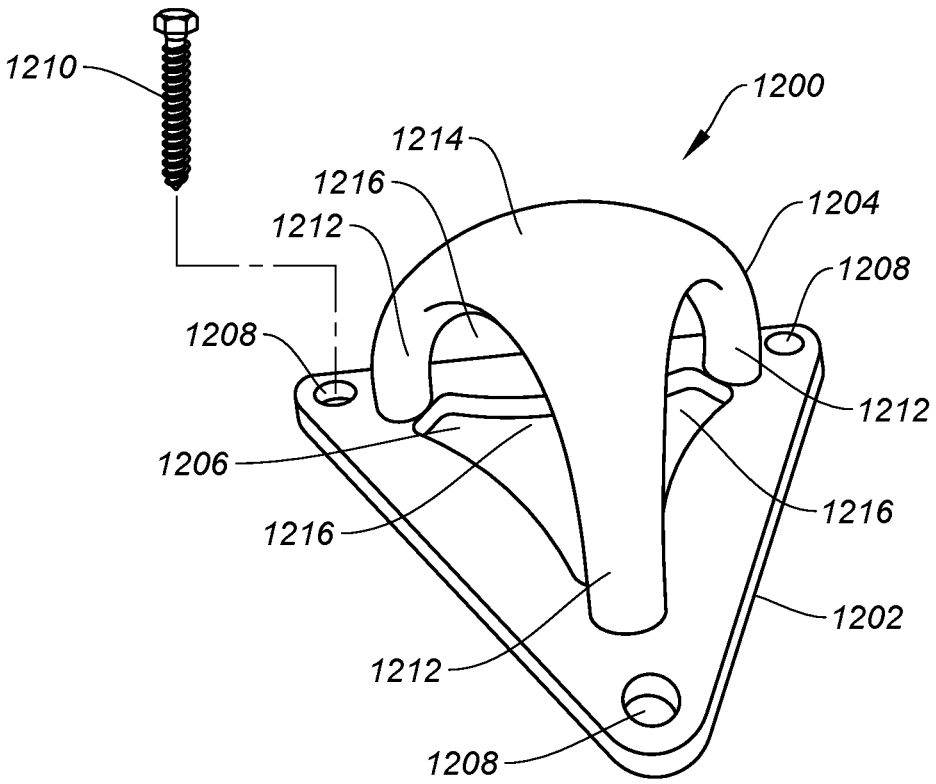
FIG. 12A is a top view of an anchor for the main strap of the exercise system of FIG. 10 according to one embodiment of the invention.

FIG. 12A is a perspective view of an anchor for the main strap of the exercise system of FIG. 10 according to one embodiment of the invention. In this embodiment, the main strap 1002 of FIG. 10 may be secured to a separate anchor 1200 that itself is secured to a fixed or stationary object, such as a wall. FIG. 12A shows a separate anchor 1200 that has a triangular base 1202 and an upper body portion 1204 that extends upward from the triangular base 1202 and to which the main strap 1002 may be attached. The triangular base 1202 defines a center opening 1206 and three openings 1208 each located at a respective corner of the triangular base 1202. Each of the three openings 1208 are configured to receive a screw 1210 or similar connector that can be used to secure the base 1202 to a stationary object. In one embodiment, each of three screws 1210 would be inserted through a respective opening 1208 at the corners of the triangular base 1202 and screwed into the surface of a stationary object, such as a wall or ceiling. The upper body portion 1204 has three portions 1212 that extend in an upward fashion from each of the corners of the triangular base 1202, respectively. The three portions 1212 meet at a location above the plane of the triangular base 1202 to form a contiguous upper surface 1214 that is positioned over the center opening 1206 formed by the triangular base 1202. This configuration, including the three portions 1212 that extend in an upward fashion to meet in a contiguous upper surface 1214 above the triangular base 1202 serves to define several openings 1216 between each adjacent pair of portions 1212 and the triangular base 1202. These openings 1216 are used in securing the main strap 1002 to the anchor 1200.

Figure 12B:
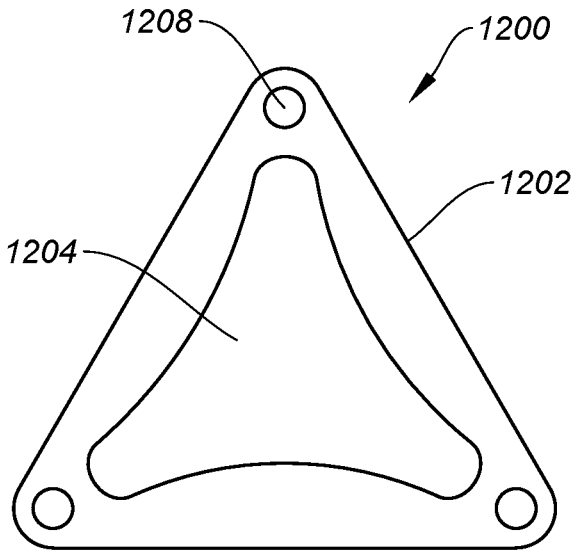
FIG. 12B is a perspective view of the anchor of FIG. 11A according to one embodiment of the invention.

FIG. 12B is a top view of the anchor of FIG. 12A according to one embodiment of the invention. As shown, this is the view that a user would have as if the anchor 1200 were attached to a vertical wall. Accordingly, as shown, the center opening 1206 formed by the triangular base 1202 would not be visible in this view.

In use, the main strap 1002 can be inserted through the openings 1216 created between the triangular base 1202 and the upper body portion 1204. In particular, the main strap 1002 would be inserted into one of these openings 1216 and, therefore, into the center of the anchor 1200 and then passed back out through a second one of these openings 1216. At that point, the carabiner 224 can be attached to an appropriate loop 1016 formed along the length of the main strap 1002 as described above in connection with FIG. 11. In essence, any of the three portions 1212 can serve as a structure around which the main strap 1002 can be secured. It should be appreciated that other shapes for the anchor 1200 can be used and other methods can be used to secure the anchor 1200 to a stationary object for use. In particular, various shapes for the base can be used and various shapes for the upper body portion can be used, provided that the main strap 1002 can be inserted into and out of a space created between the base and the upper body portion.

It should also be appreciated that the anchor 226, which is attached to one end 210 of the main strap 102 (see FIG. 4) could also be used in conjunction with the anchor 1200 shown in FIG. 12A. In one embodiment, one end 210 of the main strap 102 (see FIG. 3) can be fed through at least two of the openings 1216 and attached to the anchor 226. In this manner, when the main strap 102 is pulled, the anchor 226 would be pulled against two of the three portions 1212 that extend in an upward fashion from each of the corners of the triangular base 1202, thereby securing the main strap 102 against the anchor 1200. In another embodiment, the end 210 of the main strap 102 can be fed through at least two of the openings 1216 and attached to the anchor 226 within or under the upper surface 1214 that is positioned over the center opening 1206. In this manner, the anchor 226 would mostly reside under this upper surface 1214 and its ends may protrude through two of the openings 1216 such that the bodies 404 are outside of portions 1212 that extend in an upward fashion. Upon use, when the main strap 102 is pulled, the anchor 226 would rest against two of these portions 1212 that extend in an upward fashion thereby securing the main strap 102 to the anchor 1200.

Figure 13:
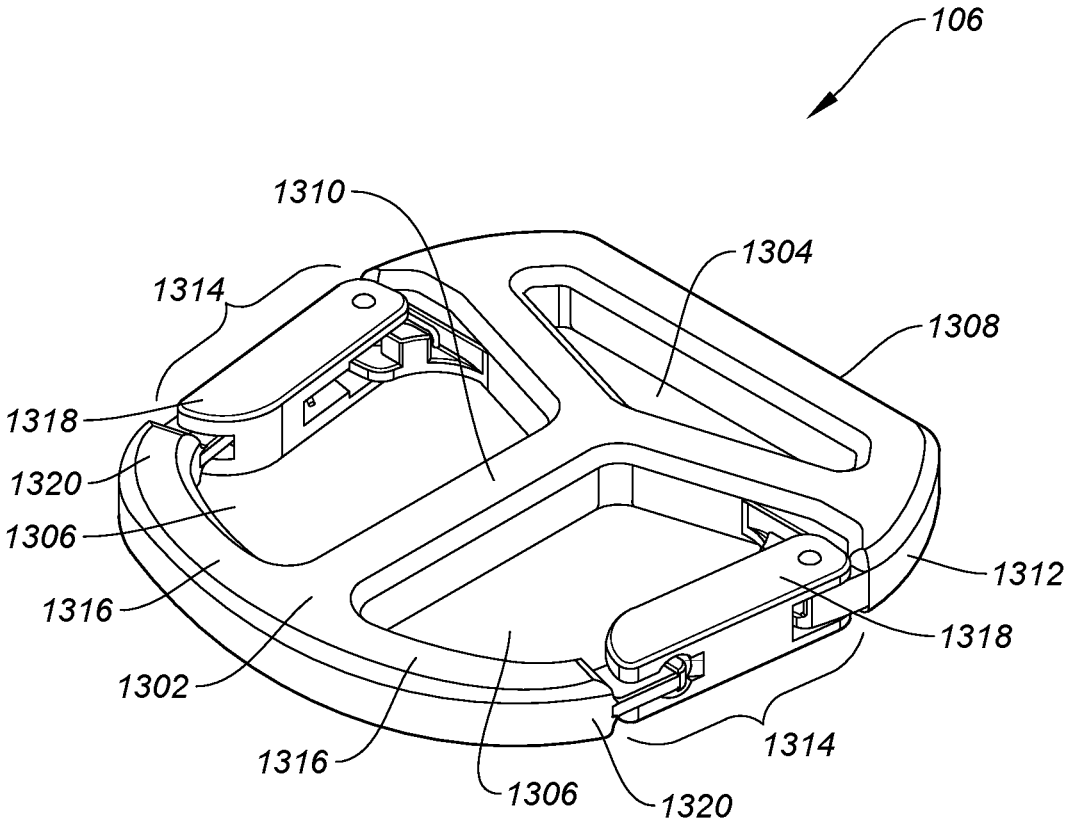
FIG. 13 is a perspective view of the main buckle of FIG. 1 according to one embodiment of the invention.

FIG. 13 is a perspective view of the main buckle of FIG. 1 according to one embodiment of the invention. The main buckle 106 is used to connect the main strap 102 to the exercise straps 104 that are engaged or held by the user during exercise. The main buckle 106 includes a buckle body 1302 that defines three openings 1304, 1306. One opening 1304 is located at one end 1308 of the main buckle 106 and is used to connect to the main strap 102. The other two openings 1306 are symmetrical and receive and secure the respective ends of a pair of the exercise straps 104. In one embodiment, these two openings 1306 are defined by the walls of the buckle body 1302 and have latch, such as a carabiner feature, that forms an integral part of the wall of the buckle body 1302 forming the openings 1306 and upon being opened allows access to the opening 1306 for purposes of looping the respective ends of the exercise straps 104 into these openings to secure the exercise straps 104 to the main buckle 106.

The buckle body 1302 is a relatively flat body that has a solid Y-shaped portion 1310 in the center and an outer perimeter portion 1312 that forms the outer perimeter of the buckle body 1302 and basically encircles or encompasses the Y-shaped portion 1310. The buckle body 1302, including the Y-shaped portion 1310 and the outer perimeter portion 1312, basically provides walls that define the openings 1304, 1306. The opening 1304 located at one end 1308 of the main buckle 106 is notably formed by a contiguous portion of the buckle body 1302, namely a combination of the upper portion of the Y-shaped portion 1310 (i.e., the "V" shaped portion of the "Y") and the perimeter portion 1312. Accordingly, the main strap 102 must be threaded through this opening 1306. With reference to the main strap 102 as shown in FIG. 2, the main strap can be passed through this opening 1306 in the main buckle 106 prior to connection of the main strap 102 with the anchor 226 for engaging a stationary object, such as a closed door. In other words, the main strap 102 can be passed through this opening 1306 in the main buckle 106 and thereafter the shaft body 402 of the anchor 226 can be passed through the loop 214 at the end 210 of the main strap 102 (see FIG. 2) and thereafter each body 404 (or one body 404 if the other body 404 was already attached to the shaft body 402) may be secured to its respective end of the shaft body 402.

Opposite or below the end 1308 of the main buckle 106 to which the main strap 102 is attached are the two symmetrical openings 1306. Both of these symmetrical openings 1306 are below the opening 1306 to which the main strap 102 is attached and both are positioned beside each other or adjacent to each other. These two openings 1306 are separated by the vertical or downward portion of the Y-shaped portion 1310. Accordingly, this vertical or downward portion of the Y-shaped portion 1310 forms a common inner wall for each of these openings 1306. The upper portion of the Y-shaped portion 1310 (essentially the V-shaped portion of the Y) forms an upper side for each of these openings 1306 and forms a common wall between each of these openings 1306 and the opening 1304 to which the main strap 102 is attached that is above these openings 1306.

The outer wall or perimeter for these openings 1306 includes a side wall portion 1314 and a bottom wall portion 1316, which are both part of the overall outer perimeter portion 1312. Each side wall portion 1314 includes a spring-loaded gate 1318, which provides a carabiner-type function that allows for the connection of a respective exercise strap 104 to the buckle body 1302. In one embodiment, the spring-loaded gate 1318 can be opened to provide an opening in the perimeter wall of the buckle body 1302 and access to the opening 1306 and passage of, for example, a loop at one end of each exercise strap 104 for connection to the buckle body 1302. Specifically, once the gate 1318 is in an open position, a tip 1320 of the bottom wall portion 1316 will be exposed and can be fed through the loop at the end of each exercise strap 104, after which the spring-loaded gate 1318 would be returned to its original closed position based on its bias. The loop of the exercise strap would then be held within the opening 1306, and during use in which the exercise strap 104 would be pulled away from the main buckle 106, the loop of the exercise strap would be pulled against and retained by the bottom wall portion 1316 of the buckle body 1302. Accordingly, the spring-loaded gate 1318 can be opened again to remove the loop of the exercise strap 104, thereby disconnecting the exercise strap 104 from the main buckle 106. It should be appreciated that by using a spring-loaded gate 1318 that is biased in the closed position, any attached exercise strap would be unable to be unintentionally detached from the buckle body 1032.

Figure 14:
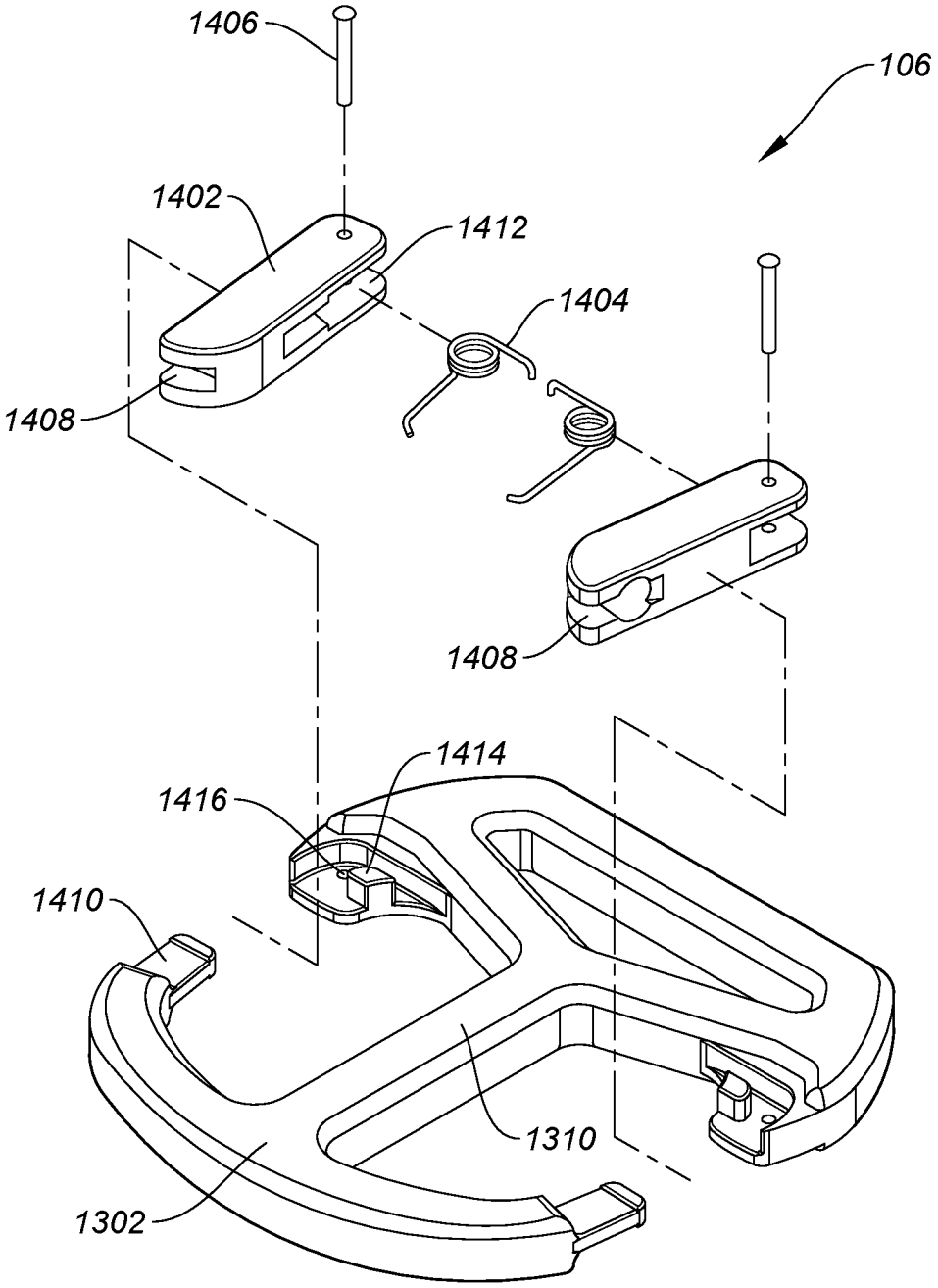
FIG. 14 is an exploded perspective view of the main buckle of FIG. 13 according to one embodiment of the invention.

FIG. 14 is an exploded perspective view of the main buckle of FIG. 13 according to one embodiment of the invention. As shown, the main buckle 106 includes the buckle body 1302, which is a solid body, and in some embodiments, it is a contiguous or single-piece body. The spring-loaded gates 1318 are positioned as, and form a part of, the side wall portions 1314 that define the sides of the openings 1306 for receipt and attachment of the exercise straps 104. As shown, each spring-loaded gate 1318 includes a gate 1402, a spring 1404, and a pin 1406.

The gate 1402 is configured to have a width and depth that is similar to or the same as the width and depth of the outer perimeter portion 1312 so that in a closed position, the outer perimeter portion 1312 provides a consistent shape throughout its length. Each gate 1402 includes a recessed slot 1408 at one end of the gate 1402 for receipt of a limit tab 1410 that is part of, or attached to, the buckle body 1302. At an opposite end of the gate 1402 a second recessed slot 1412 that accommodates the spring 1404, which is coiled and positioned around the pin 1406 that extends vertically from the top of the gate 1402, through the body of the gate 1402, to a hole 1414 located on a pivoting surface 1416 of the buckle body 1302. Accordingly, at this end of the gate 1402, the gate may pivot about the pin 1406 by being pushed against the spring 1404 bias to rotate into the opening 1306, such that its opposite end moves toward the vertical or downward portion of the Y-shaped portion 1310. At this point, the gate 1402 would be in an open position. Without any push or external force applied to the gate 1402, the bias of the spring 1404 will force the gate 1402 to pivot in the opposite direction or away from the opening 1306 into a closed position. The gate 1402 will pivot in this direction until it is stopped by the limit tab 1410 abutting against the back wall of the recessed slot 1408. At this point, the gate 1402 would be in a closed position and would again generally conform to and form a part of the side wall portion 1314 of the outer perimeter portion 1312.

Figure 15:
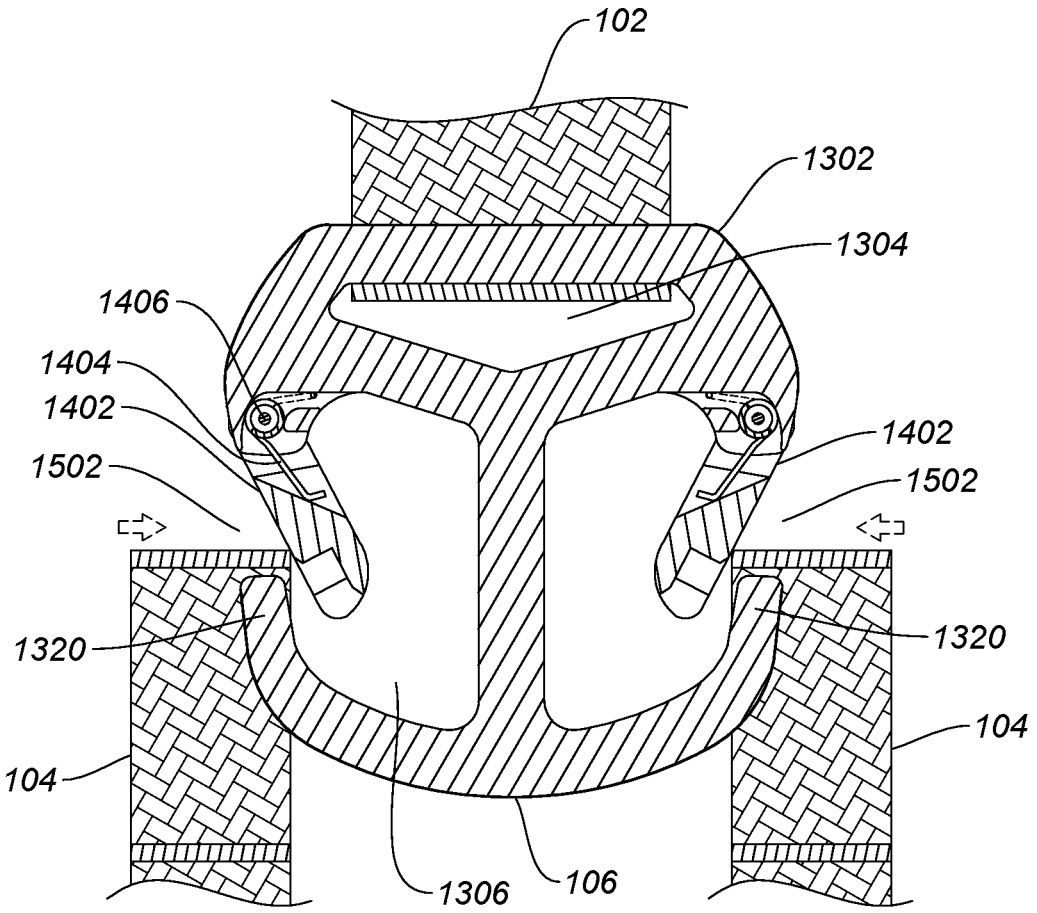
FIG. 15 is a cross-sectional top view of the main buckle of FIG. 13 according to one embodiment of the invention.

FIG. 15 is a cross-sectional top view of the main buckle of FIG. 13 according to one embodiment of the invention. As shown, the main buckle 106 is shown with the main strap 102 attached to the buckle body 1302 at the end 1308 using the upper opening 1304 of the buckle body 1302. Also as shown, the gates 1402 have been pushed into a partially open position. In other words, an external force (basically the pushing of the exercise straps 104 against the gate 1402 in the direction of the arrows shown) has pushed on the gate 1402 against the force of the spring 1404 such that the gate 1402 has pivoted around the axis of the pin 1406 causing the opposite end of the gate 1402 to move into the opening 1306. Accordingly, with the gate 1402 in this open position, an opening 1502 is created along the side wall portion 1314 of the outer perimeter portion 1312 of the buckle body 1302. This opening 1502 permits the passage of the end of the exercise straps 104, for example, a loop at the end of the exercise straps 104, to be moved past the gate 1402 and into the opening 1306 (again as shown by the direction of the arrows). Further, each exposed tip 1320 of the bottom wall portion 1316 can be fed through the loop at the end of each exercise strap 104.

Figure 16:
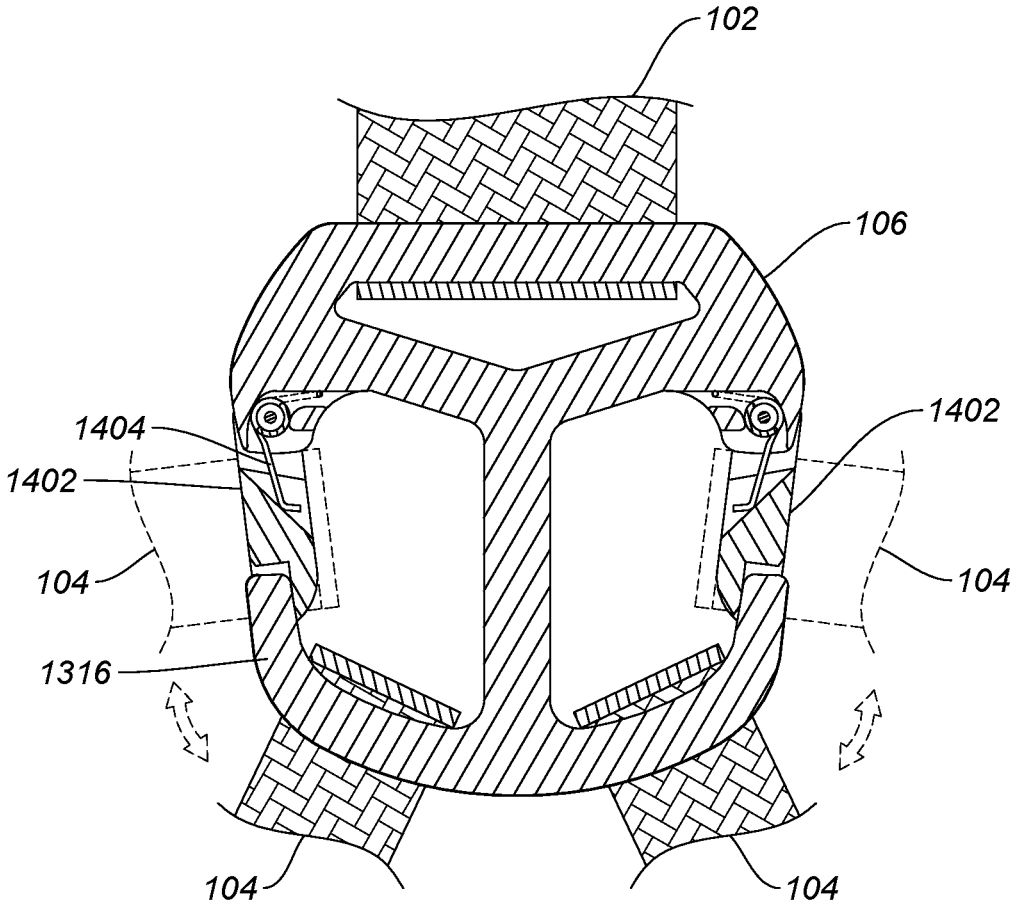
FIG. 16 is another cross-sectional top view of the main buckle of FIG. 13 according to one embodiment of the invention.

FIG. 16 is another cross-sectional top view of the main buckle of FIG. 13 according to one embodiment of the invention. FIG. 16 illustrates the completed attachment of the exercise straps 104 to the main buckle 106. As shown, the gates 1402, after having been in an open position as shown in FIG. 15, are now in a closed position and again generally conform to and form a part of the side wall portion 1314 of the outer perimeter portion 1312 of the buckle body 1302. Accordingly, it should be appreciated that after the exercise straps 104 have been looped onto the buckle body the gates 1402 return to a closed position due to the bias of the spring 1404, thereby closing the opening provided when the gates 1402 were open and preventing the exercise straps from being inadvertently detached from the main buckle 106. Additionally, it should be appreciated that during use, the exercise straps, if attached to the main buckle 106 using loops, can slide to different positions (shown by the dashed line version of the exercise straps 104) along the side wall portion 1314 and bottom wall portion 1316 of the outer perimeter portion 1312 of the buckle body 1302 (see FIG. 13) as necessary. In this case, however, the exercise straps 104 will not detach from the buckle 106 since the gates 1402 are in a closed position.

Figure 17:
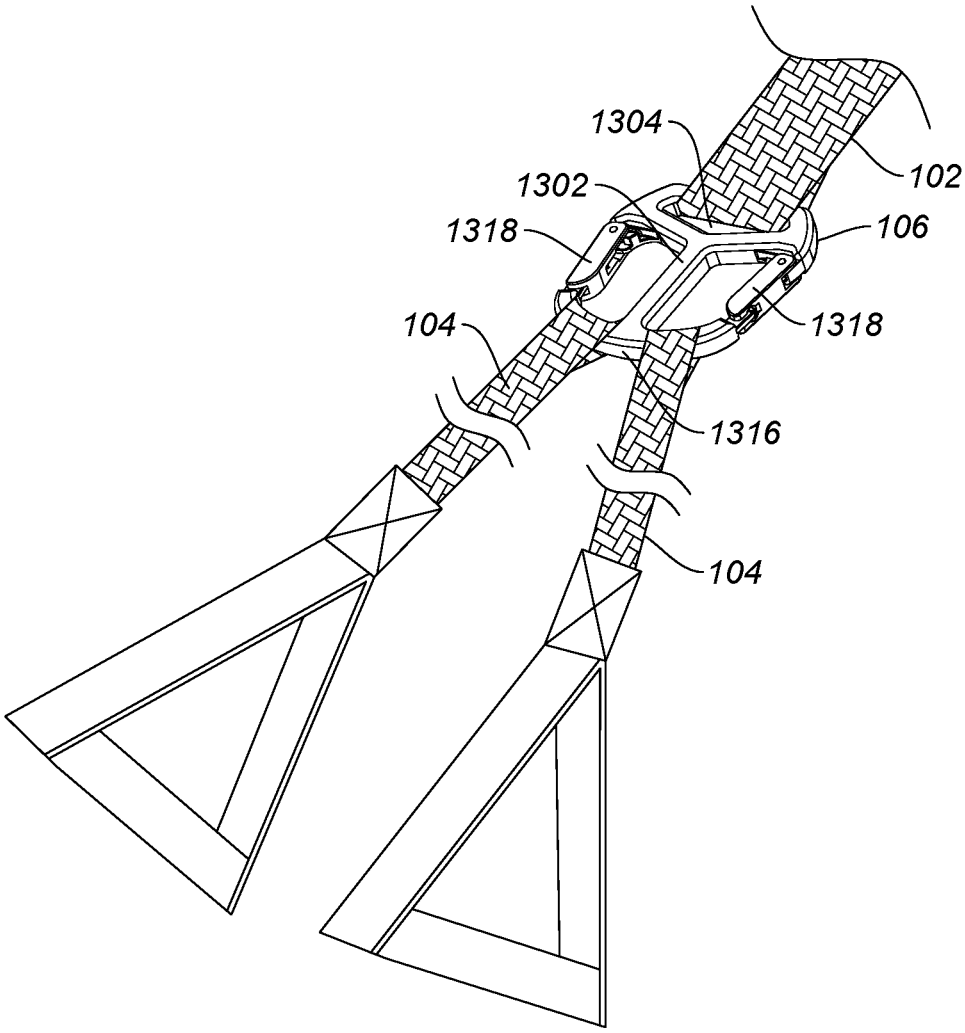
FIG. 17 is a perspective view of the main buckle of FIG. 13 according to one embodiment of the invention.

FIG. 17 is a perspective view of the main buckle of FIG. 13 according to one embodiment of the invention. As shown, the main strap 102 is attached to the buckle body 1302 at the end 1318 using the upper opening 1304 of the buckle body 1302. Each of the exercise straps 104 have been attached to the main buckle 106 via the gates 1318, which are shown in a closed position. Accordingly, in use, when a user pulls on the exercise straps 104 in a direction opposite to that of the main strap 102, the exercise straps 104 will generally reside against the bottom wall portion 1316 of the buckle body 1302. It should be appreciated that if, in use, the exercise straps 104 are extended in opposite directions from each other, the exercise straps have the ability to slide along the bottom wall portion 1316 and even over the side wall portion 1314, including the gates 1318 without risk of detaching from the main buckle 106.

In general it should be appreciated that the main buckle 106 as described above provides for the ability to attach the main strap 102 to each of the two exercise straps 104 with only one device or body. Moreover, the main buckle 106, via the carabiner feature of the spring-loaded gates, provides the ability to easily and securely attach the two exercise straps 104. Further, the main buckle 106, via the carabiner feature of the spring-loaded gates, provides the ability to easily attach and detach the two exercise straps 104 without having to detach the main strap 102 from any stationary object to which it is attached. This allows for the ability to attach other types of exercise equipment to the main buckle 106 with relative ease. While the main buckle 106 may be constructed from any material, such should be suitable to withstand the forces to which it will be subjected during use to avoid failure and detaching or either the main strap 102 or the exercise straps 104. In some embodiments, the main buckle 106 is made from a metal material, such as aluminum, including 7075 Aluminum.

Figure 18:
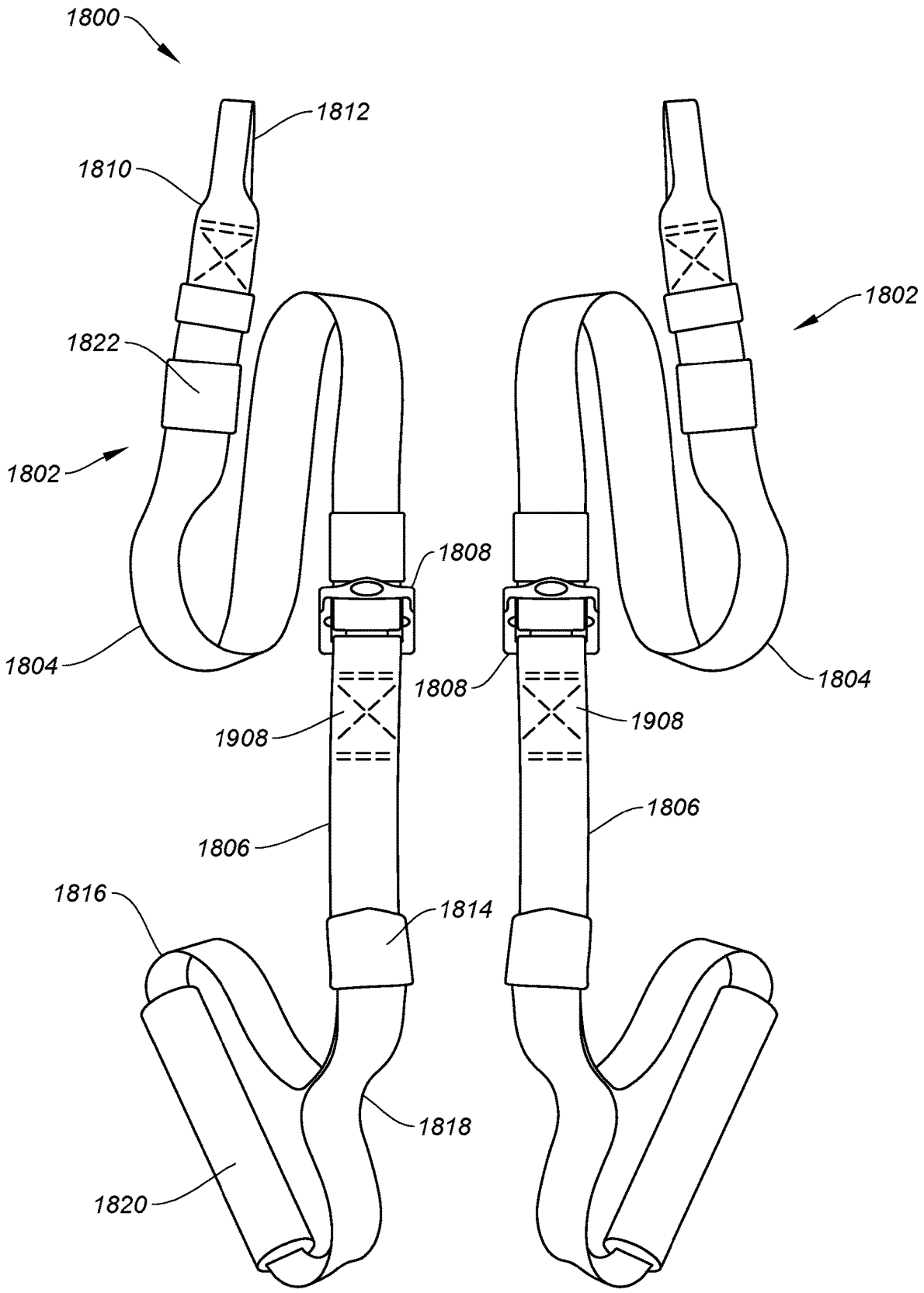
FIG. 18 is a perspective view of a pair of exercise straps according to one embodiment of the invention.

FIG. 18 is a perspective view of a pair of exercise straps according to one embodiment of the invention. As shown, the pair of exercise straps 1800 are one embodiment of the exercise straps 104 shown in FIG. 1. In this embodiment, each exercise strap 1802 is an inelastic strap. Each exercise strap 1802 includes two separate inelastic straps including an upper strap 1804 and a lower strap 1806 that are attached together using an exercise strap buckle 1808. It should be appreciated that the length of the upper strap 1804, and, therefore, the overall length of the exercise strap 1802, may be adjusted using the exercise strap buckle 1808 as described below. Each upper strap 1804 includes one end 1810 that includes a loop 1812 for attachment to the main buckle 106 (see FIG. 1) as described in connection with FIGS. 13-17. Each lower strap 1806 also includes an end 1814 opposite or furthest from the upper strap 1804 that includes a handle 1816 for engagement or gripping by a user during exercise. The inelastic exercise straps 1802 may be made from any material sufficient to withstand the force applied to it during use. In one embodiment, the inelastic exercise straps 1802 are made from a nylon material.

Each handle 1816 includes a handle strap 1818 and a handle grip 1820. The ends of the handle strap 1818 are connected together and connected to the end 1814 of the lower strap 1806, which may be done, for example, using stitching. The handle grip 1820 is a hollow cylinder having an opening that extends through the middle of the tube that may be made from plastic or similar material. The surface of the tube may have a rubber or similar coating to facilitate gripping by the user. The handle strap 1818 passes through the opening in the cylinder. It should be appreciated that the length of the handle strap 1818 may vary to accommodate use by hands or feet of a user. In one embodiment, the handle strap has a length sufficient to allow a user to use hands or feet to engage the handle grip 1820. The handle strap 1818 may be a single length of material, such as a nylon material, with its ends stitched together to form the loop of material that passes through the handle grip 1820. In one embodiment, the stitching used to connect the ends of the handle strap 1818 to each other can be positioned within the opening of the handle grip 1820.

Figure 19A:
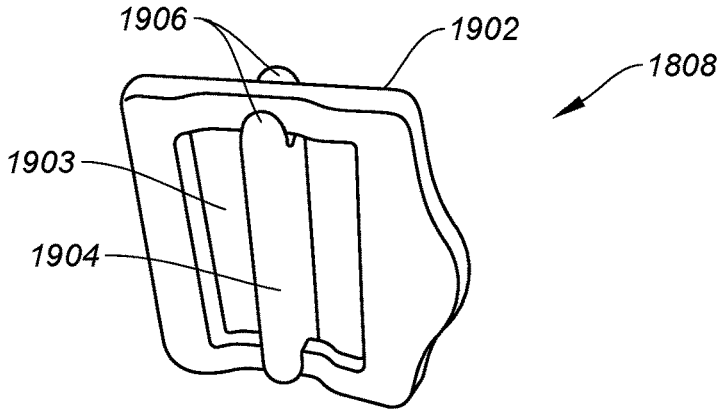
FIG. 19A is a perspective view of the exercise strap buckle used with the exercise straps of FIG. 18 according to one embodiment of the invention.

FIG. 19A is a perspective view of the exercise strap buckle used with the exercise straps of FIG. 18 according to one embodiment of the invention. The buckle 1808 includes a buckle body 1902, which is basically a relatively flat square or rectangular shape that defines a center opening 1903 having a rectangular or square shape, and a center piece 1904 that is held in the interior or opening defined by the buckle body 1902. The center piece freely slides along a given pair of opposing sides of the buckle body 1902 but is held within the buckle body 1902 by four tabs 1906 that extend from the corners of the center piece 1904 such that they are disposed outside of the perimeter of the buckle body 1902, thus preventing the center piece 1904 from being removed from the buckle body 1902. The buckle body 1902 and the center piece 1904 may be made from metal or any other material sufficient to withstand any force placed upon them during use.

Figure 19B:
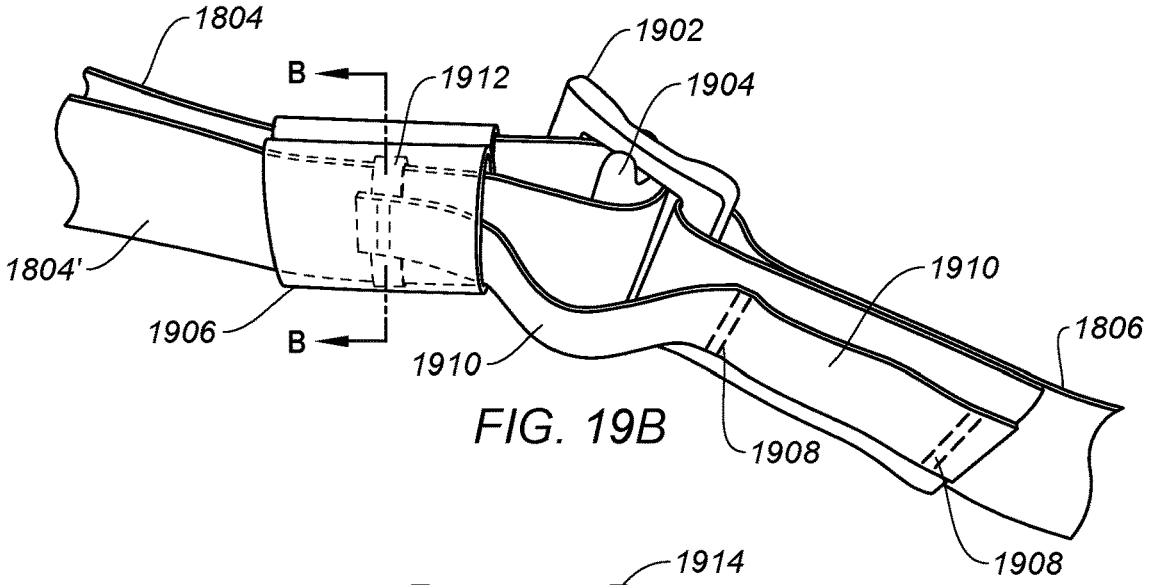
FIG. 19B is a perspective view of the exercise strap buckle attached to the exercise straps according to one embodiment of the invention.

FIG. 19B is a perspective view of the exercise strap buckle 1808 attached to the exercise straps according to one embodiment of the invention. In this embodiment, the upper strap 1804 is passed from one side of the buckle body 1902, through the buckle opening 1903 to the other side, around the buckle center piece 1904 and back through the buckle opening 1903. Accordingly, the upper strap 1804 after passing through the buckle 1808 basically doubles back on itself creating a second upper strap 1804' that runs parallel to the upper strap 1804. In this embodiment, when a force is exerted on the upper strap 1804, the center piece 1904 of the buckle 1808 will be pulled against the buckle body 1902, thereby squeezing the upper strap 1804 within the buckle body 1902 and preventing it from freely passing through the buckle body 1902. More particularly, in one embodiment, the center piece 1904 has a smooth rounded side that extends from one side of the buckle body 1902 to the opposite side of the buckle body 1902 and an opposite side that has a plurality of bumps to provide a gripping action against one side of the upper strap 1804 as it passes through the buckle body 1902. In this manner, when a force is exerted on the upper strap 1804, such as during exercise, the loop of the upper strap 1804, formed by passing through the buckle body and around the center piece 1904, pulls the center piece 1904 against the frame of the buckle body 1902 in a direction toward the upper strap 1804, thereby compressing the upper strap 1804 between the center piece 1904 and the buckle body 1902. In one embodiment, the face or side of the center piece 1904 that is against, or in contact with, the upper strap 1804 when a force is applied to the upper strap and it is taunt, contains the plurality of pointed bumps to facilitate its engagement with the upper strap 1804 and to aid in preventing movement of the upper strap 1804 through the buckle body 1902. In other words, the bumps are designed to engage the material or fabric used in the upper strap 1804 to hold it securely when the upper strap 1804 is being used or in a taunt position.

The two straps 1804, 1804' are held against each other using an upper strap sleeve 1906 that is located on the upper strap 1804 side of the buckle body 1902. This upper strap sleeve 1906 may be made from an elastic nylon material and may be formed into a sleeve or loop by stitching the ends of the material used to make the upper strap sleeve 1906 together, thereby forming an interior opening that through which both portions of the strap 1804, 1804' can slide in either direction. The lower strap 1806 is simply looped around one end of the buckle body 1902, which is the end opposite to that where the upper strap 1804 passes through the buckle body 1902. The end of the lower strap 1806 after looping around one end of the buckle body 1902 is folded back onto itself and attached to itself, for example, using stitching 1908 (also shown in FIG. 18), thereby creating a loop used in attachment of the lower strap 1806 to the buckle body 1902.

A safety strap 1910 is attached at one end to the lower strap 1806 and may be attached by stitching to the lower strap 1806. In one embodiment, the safety strap 1910 may be attached to the same location where the lower strap 1806 is folded back onto itself and attached using stitching 1908. The safety strap 1910 is also attached at an opposite end to the upper strap sleeve 1906. The safety strap 1910 is designed such that any failure by the buckle 1808 to hold either the upper strap 1804 or the lower strap 1806, which would otherwise result in the loss of a connection between these two straps, would be prevented. In such a case, upon failure of the buckle 1808, such that the upper strap 1804 and the lower strap 1806 would no longer be held together, the safety strap 1910 would still keep the upper strap 1804 and the lower strap 1806 connected. Otherwise, the separation of the upper strap 1804 from the lower strap 1806 could result in the user being surprisingly unbalanced. It should be appreciated that the safety strap 1910 may be made from an inelastic material such that its strength is sufficient to avoid tearing upon the sudden application of force that it may experience. For example, if the buckle failed, the user's weight or force being applied to the lower strap 1806 would suddenly be applied to the safety strap 1910. Accordingly, the safety strap 1910 should have sufficient strength, such as tensile strength, to withstand such forces.

Figure 19C:
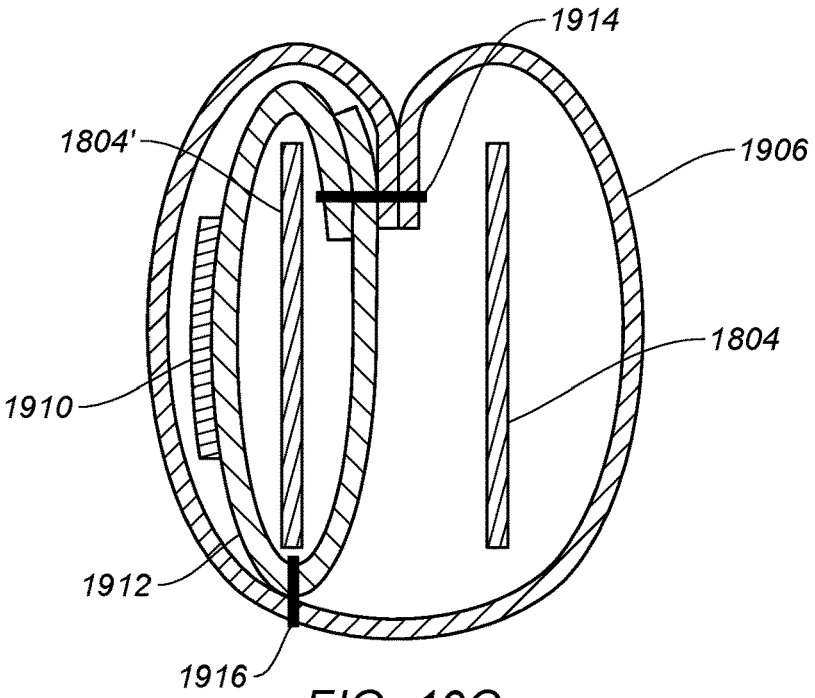
FIG. 19C is a cross-sectional view taken along line B-B of the portion of the exercise strap of FIG. 19B according to one embodiment of the invention.

FIG. 19C is a cross-sectional view taken along line B-B of the portion of the exercise strap of FIG. 19B according to one embodiment of the invention. FIG. 19C illustrates in more detail the connection of the safety strap 1910 to the upper strap sleeve 1906. As shown, a separate loop of material 1912 is located within the upper strap sleeve 1906. This separate loop of material 1912 may be made from the same inelastic material as the upper strap sleeve 1906. The ends of this separate loop of material 1912 may be sewn together to complete the formation of the loop. In one embodiment, the ends of the separate loop of material 1912 may be sewn together at the same location 1914 as where the ends of the material used to form the upper strap sleeve 1906 are sewn together. In addition, this separate loop of material 1912 may also be attached at a second location to the inside bottom of the upper strap sleeve 1906 using a second set of stitching 1916. It should be appreciated, however, that the upper strap 1804, in particular upper strap 1804', passes freely through the center of this separate loop of material 1912 and, accordingly, through the upper strap sleeve 1906, in either direction. In particular, it should be appreciated that both portions of the upper strap 1804, 1804' pass freely through the center of this separate loop of material 1912 and, accordingly, through the upper strap sleeve 1906, in either direction, which facilitates the ability to adjust the length of the upper strap 1804 using the buckle 1808. In this manner, the safety strap 1910 is indirectly connected to the upper strap 1804 in that if the buckle 1808 failed, the loop formed by the lower strap 1806 as it passes through the buckle body 1902 would be held by the separate loop of material 1912 within the upper strap sleeve 1906, thereby preventing the separation of the upper strap 1804 from the lower strap 1806.

With reference to FIG. 19B, the length of the upper strap 1804 may be adjusted by pulling one portion of the upper strap 1804 through the buckle. It should be appreciated that one portion of the upper strap 1804' has a terminal end that is simply gathered and held against the other portion of the upper strap 1804 by a sleeve 1822 that encompasses both portions of the upper strap 1804, 1804' (see FIG. 18) located away from the buckle 1808 and closer to the end of the upper strap 1804 where the loop 1812 for connection to the main buckle 106 is located. This sleeve 1822 is attached directly to the terminal end of the portion of the upper strap 1804'. It should be appreciated, however, that this sleeve 1822 can slide along the upper strap 1804 along with the terminal end of the upper strap 1804'. Accordingly, to lengthen the overall length of the upper strap 1804, the portion of the upper strap 1804' could be made shorter by pulling this portion of the upper strap 1804' through the buckle body 1902, thereby making the length of the other portion of the upper strap 1804 longer. In this case, the terminal end of the upper strap 1804' and the sleeve 1822 would both be located closer to the buckle body 1902. Alternatively, by pulling that portion of the upper strap 1804' (and the sleeve 1822) away from the buckle body 1902, the portion of the upper strap 1804 would become shorter. Accordingly, it should be appreciated that by adjusting the length of the upper strap 1804, the overall length of the exercise strap 1802 would be adjusted to the user's desired length. It should also be appreciated that the sleeve 1822 prevents either the terminal end 1804' or the end of the upper strap 1804 where the loop 1812 for connection to the main buckle 106 is located (i.e., the other terminal end of the upper strap 1804) from passing through this sleeve 1822. Accordingly, this sleeve 1822 also indirectly prevents these ends from sliding through the upper strap sleeve 1906 in the event of a failure of the buckle 1808 or the corresponding buckle body 1902.

Figure 20:
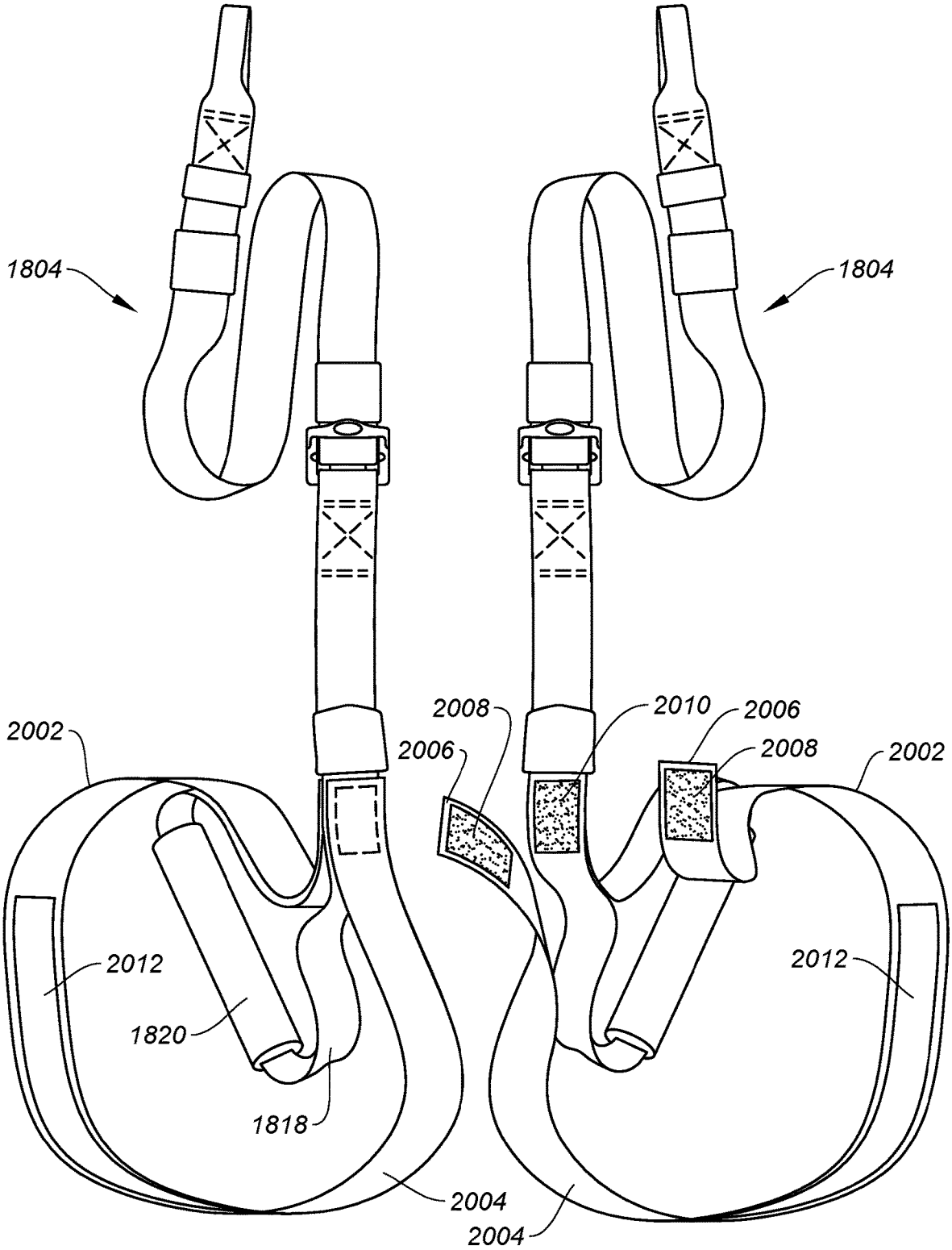
FIG. 20 is a perspective view of the exercise straps of FIG. 18 in conjunction with an additional foot hammock according to one embodiment of the invention.

FIG. 20 is a perspective view of the exercise straps of FIG. 18 in conjunction with an additional foot hammock according to one embodiment of the invention. In this embodiment, a foot hammock 2002 can be attached to the handle strap 1818 of each of the exercise straps 1802. The foot hammock 2002 includes a foot hammock strap 2004 having two ends 2006, each with one part of a corresponding fastener 2008, such as one part of a hook or a loop fastener or VELCRO fastener. The foot hammock strap 2004 can be an inelastic material, such as a nylon material. A companion or corresponding fastener 2010 is located on each side of each handle strap 1818 near the point where the handle strap 1818 is attached to the end of the lower strap 1806. The foot hammock strap 2004 is attached at each end 2006 to the corresponding fasteners 2010 on the handle strap 1818. The length of the foot hammock strap 2004 is such that it is longer than the length of the handle strap 1818. Accordingly, when taunt, the foot hammock strap 2004 will extend around and below the existing handle or grip 1820. In this manner, the heel or back of a user's foot can be rested on the foot hammock strap 2004 such that the mid-section or arch of the bottom of the user's foot can be rested against the grip 1820 for additional support during exercise. A comfort strap 2012 of a soft material may be attached along a given length of the foot hammock strap 2004 on the surface of the foot hammock strap 2004 facing inward when attached to the handle strap 1818. This comfort strap 2012 may provide a soft surface upon which the user's heel or back of the foot would rest during exercise to avoid rubbing or chaffing by the underlying inelastic material of the foot hammock strap 2004.

In use, the exercise straps described above in connection with FIGS. 18-20 would be attached to the main buckle 106 as described above. The main strap 102, either the main strap 102 described in connection with FIGS. 2-9 or the main strap 1002 described in connection with FIGS. 10-12B, would be attached to a fixed or stationary object, thereby providing an anchor for the exercise system. The exercise straps 1800 could then be used by a user for exercise. It should be appreciated that because the exercise straps described above in connection with FIGS. 18 and 19A-C are inelastic the use or exercises performed using these exercise straps generally require that the exercise straps be of equal length and remain taunt during the exercise. In other words, in most exercises using the inelastic straps, the straps will remain taunt and the user's body would move relative to the straps. Some exercises that may be performed in this manner include a chest press, chest fly, press up, close grip press up, archer press up, wide row, narrow, single arm reach to row, archer row, reverse fly, suspended squat, suspended squat jump, hanging lunge, plyo lunge, hamstring curls, plank, reverse plank, knee tucks, pike, and pendulum crunches.

Figure 21:
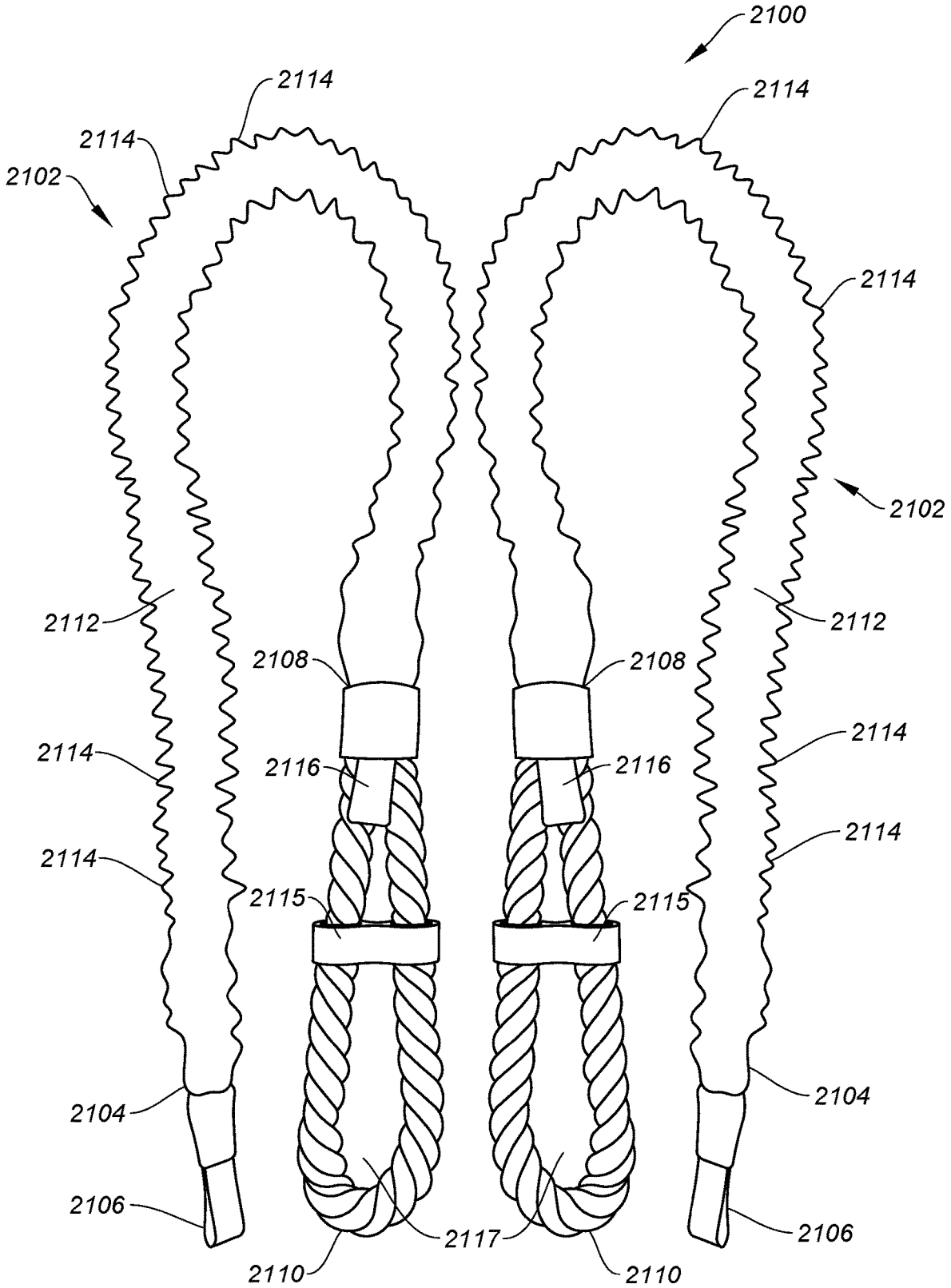
FIG. 21 is a perspective view of a pair of exercise straps according to another embodiment of the invention.

FIG. 21 is a perspective view of a pair of exercise straps according to another embodiment of the invention. As shown, the pair of exercise straps 2100 are another embodiment of the exercise straps 104 shown in FIG. 1. In contrast to the exercise straps 1800 shown in connection with FIG. 18, the exercise straps 2100 shown in FIG. 21 are elastic straps that allow a user to apply a force to the strap by pulling on the strap and extend it against a resistance provided by the material of the elastic strap itself, which then automatically returns to its original length when the user releases the force applied.

Each elastic exercise strap 2102 has one end 2104 that is configured to attach to the main buckle 106, including the main buckle described in connection with FIGS. 13-17. In one embodiment, each end 2104 is attached to a connector 2106 to connect to the main buckle 106. In one embodiment, the connector 2106 includes a loop of material 2106 for connection to the main buckle 106. This loop of material 2106 may be an inelastic material such as a nylon material. Each elastic exercise strap 2102 has another end 2108 at the end of the length of the exercise strap 2102 and opposite to the one end 2104 that is configured to attach to a handle 2110 that is engaged or gripped by a user during exercise to pull on each respective elastic strap 2102.

Each elastic exercise strap 2102 has a fixed length when not being stretched that is selected based upon a comfortable length for use during exercising. It should be appreciated, however, that the length of the elastic exercise strap 2102 can be made to be any length desired. As described further below in connection with FIG. 22, each elastic exercise strap 2102 has an elastic inner member 2202 (see FIG. 22A) that extends the entire length of the elastic exercise strap 2102 and that can be reversibly stretched in that it can be pulled and stretched in a longitudinal direction and upon release of the pulling force will automatically return to its original length. In some embodiments, this inner member 2202 is a hollow elastic tube that may be a hollow rubber tube; however, it should be appreciated that any elastic longitudinal tube may be used. This inner member 2202, however, is encompassed by an outer cover 2112 that also extends the entire length of the elastic exercise strap 2102 from one end 2104 to the other end 2108. As shown, this outer cover 2112 may be constructed of a cloth material, including, for example, a cotton, canvas, or plastic-based material, such as nylon, and is basically in the shape of a cylinder. This outer cover 2112, however, has a length that is greater than the length of the elastic exercise strap 2102 such that when attached at its ends to the ends 2104, 2108 of the elastic exercise strap 2102, the outer cover 2112 is not taunt and, therefore, provides a multitude of creases or folds 2114 along its length and about its diameter. In other words, the outer cover 2112 has creases and folds over the entirety of the material from which it is constructed. It should be appreciated that in some embodiments, the length of the outer cover 2112 is longer than the maximum length that the elastic inner member 2202 when stretched to its longest length. It should be appreciated that in use, the outer cover 2112 prevents or minimizes any movement of the cord resulting upon release of any tension or force put on the elastic exercise strap 2102 by the user. In some situations, once the user releases an elastic exercise strap, in returning to its normal position, it may bounce or wave in an uncontrolled manner and may hit or injury the user. Through the use of the outer cover 2112, such uncontrolled movement is minimized or prevented, thereby making the use of the elastic exercise straps 2100 more safe. As the elastic inner member 2202 is stretched by a user, the outer cover 2112 is also stretched. Because the length of the outer cover 2112 is longer than the elastic inner member 2202 it can be stretched to the same length as the elastic inner member 2202 without becoming disconnected from the ends of the elastic exercise strap 2102.

Figure 22A:
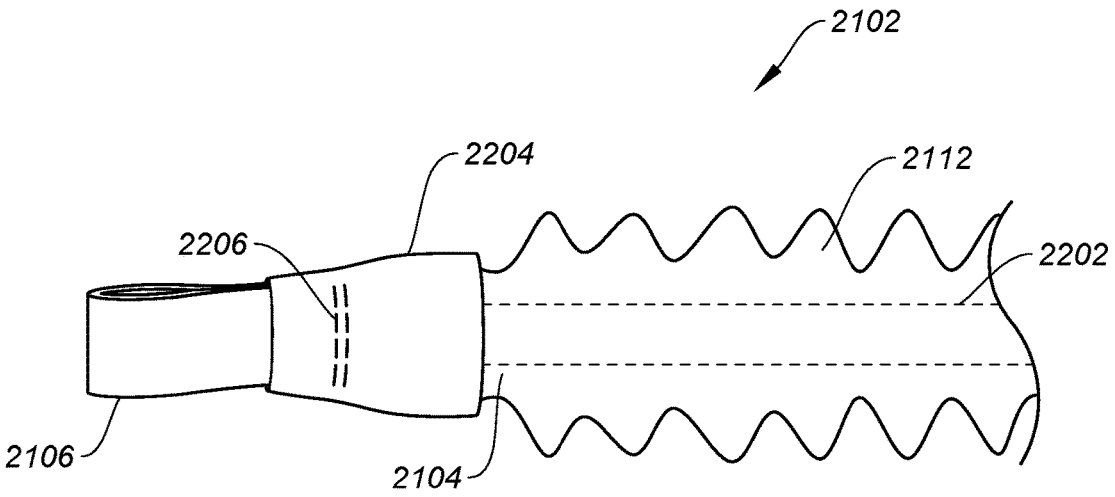
FIG. 22A is a perspective view of one end of the exercise straps of FIG. 21 according to one embodiment of the invention.

FIG. 22A is a perspective view of one end of the exercise straps of FIG. 21 according to one embodiment of the invention. As shown, one end 2104 of one of the elastic exercise straps 2102 is shown. The outer cover 2112 is shown as covering the elastic inner member 2202 (shown as a tube with dashed lines). As described above, at the end 2104 of the elastic exercise strap 2102, there is a connector 2106 for connection to the main buckle 106. A connector covering 2204 is used to cover or encompass the connection between the end 2104 of the elastic exercise strap 2102 and the connector 2106 for connection to the main buckle 106. This connector covering 2204 may be any material, including plastic, such as a thin plastic wrap or an inelastic material. The connector covering 2204 can be sewn by stitching 2206 to the connector 2106 to secure the connector covering 2204 in place. It should be appreciated that the end of the outer cover 2112 may extend to this same point such that the outer cover 2112 is secured by the same stitching 2206 (see FIG. 22B).

Figure 22B:
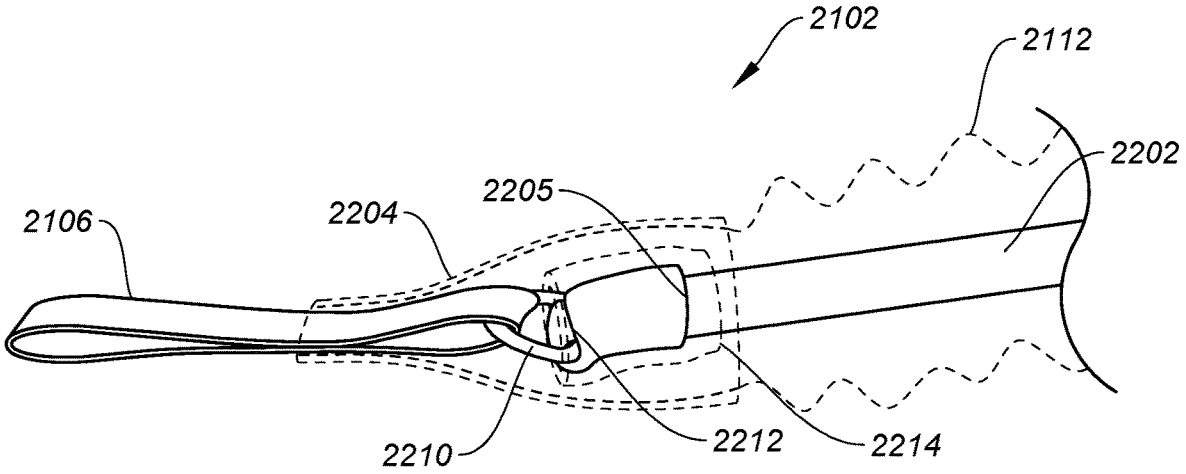
FIG. 22B is a perspective view of the end of the exercise strap of FIG. 22 illustrating the connection between the exercise strap and a connector for connecting to the main buckle according to one embodiment of the invention.

FIG. 22B is a perspective view of the end of the exercise strap of FIG. 22 illustrating the connection between the exercise strap and a connector that connects to the main buckle according to one embodiment of the invention. The connector covering 2204 and the outer cover 2112 are both shown by dashed lines. The elastic inner member 2202 as described above may be a hollow tube, such as a hollow rubber tube, that is elastic and capable of being pulled along its longitudinal axis or in the direction of its length, in which case its length will be increased in response to the force pulling on it. Upon the release of that force, the elastic inner member 2202 will return automatically to its original length.

The end 2205 of the elastic inner member 2202 is attached to a ring member 2210, such as a metal D-ring, although any type of connector for connecting two pieces of material may be used, which, in turn, is attached to the connector 2106 that connects to the main buckle 106. The end 2205 of the elastic inner member 2202 is attached to the ring member 2210 by the use of a slot or opening 2212 in the body of the elastic inner member 2202. Because the elastic inner member 2202 is elastic, its body is also deformable. Therefore, the elastic inner member 2202 can be fed through and around the ring member 2210 and then fed into the slot or opening 2212 such that the elastic inner member 2202 passes through the inside of itself near the end 2205 and out towards the other end of the elastic exercise strap 2102. In this configuration, the elastic inner member 2202 is secured to the ring member 2210. An elastic cap 2214 (shown by dashed lines), which may be made from the same or similar material as the elastic inner member 2202, can be attached to cover the connection between the end 2205 of the elastic inner member 2202 where it is attached to the ring member 2210 to further secure the connection between the elastic inner member 2202 or tube and the ring member 2210. In other words, the elastic cap 2214 may provide a tight fit encompassing the connection between the elastic inner member 2202 and the ring member 2201 to further ensure that the connection does not weaken or fail. In some embodiments, the elastic cap 2214 may be the same material as the elastic inner member 2202 and may be a hollow rubber tube that provides a tight friction fit around the end 2205 of the elastic inner member 2202 where it is attached to the ring member 2210 and may cover a portion or all of the ring member 2210 as well.

Figure 23:
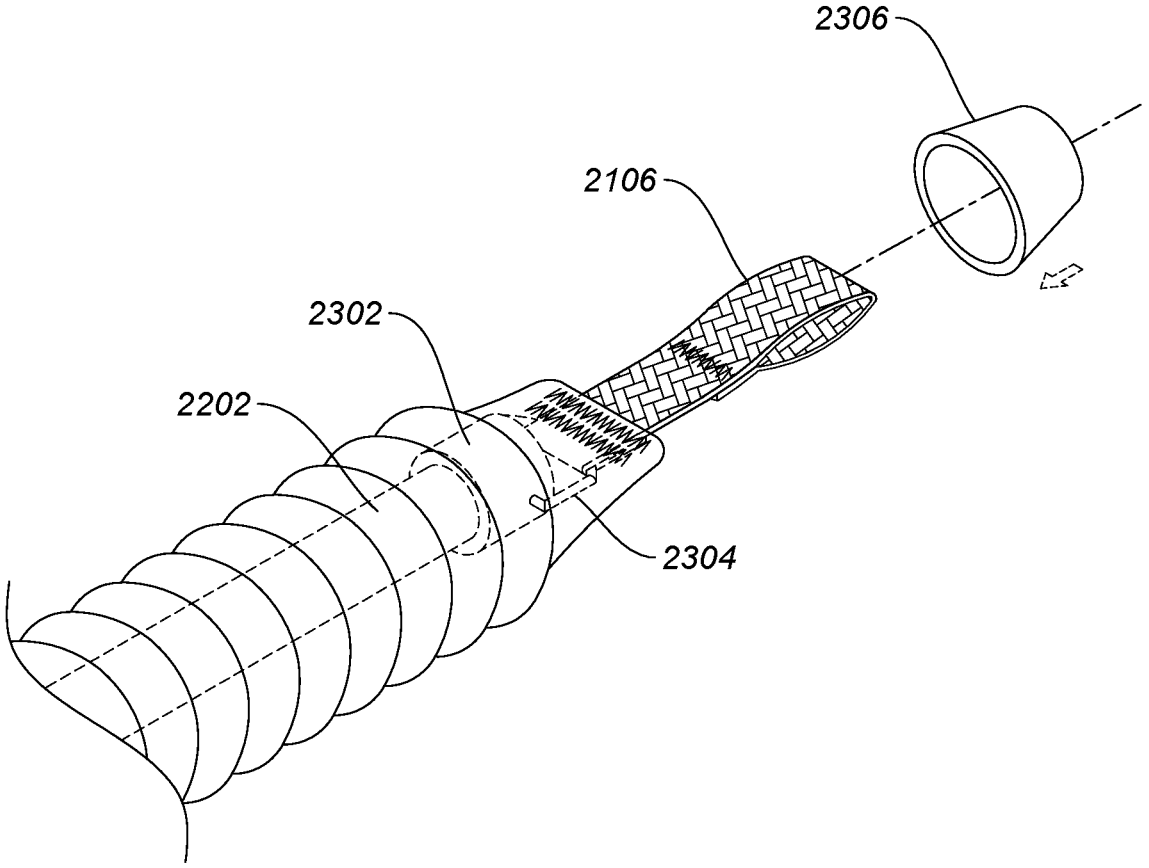
FIG. 23 is a perspective view of one end of the exercise straps of FIG. 21 according to another embodiment of the invention.

FIG. 23 is a perspective view of one end of the exercise straps of FIG. 21 according to another embodiment of the invention. As shown, another embodiment for connecting the elastic inner member 2202 includes the use of a cap 2302 (shown by dashed lines) that is tightly fitted around the end of the elastic inner member 2202. This cap 2302 may be the same or similar to the elastic cap 2214 as described above in connection with FIG. 22B. In this embodiment, a connector 2304 (shown in dashed lines), which may be a ring connector such as a D-ring connector, is attached to the elastic cap 2214 at one end and at its other end to the connector 2106 that connects to the main buckle 106. A cover cap 2306, similar to the connector covering 2204 described above in connection with FIG. 22A, is fit over the connections between the elastic inner member 2202 and the cap 2302, the cap 2302 and the connector 2304, and the connector 2304 and the connector 2106 that connects to the main buckle 106. This cover cap 2306 may be a cloth or hard plastic material and can be attached by friction fit or sewn or glued in place.

Figure 24A:
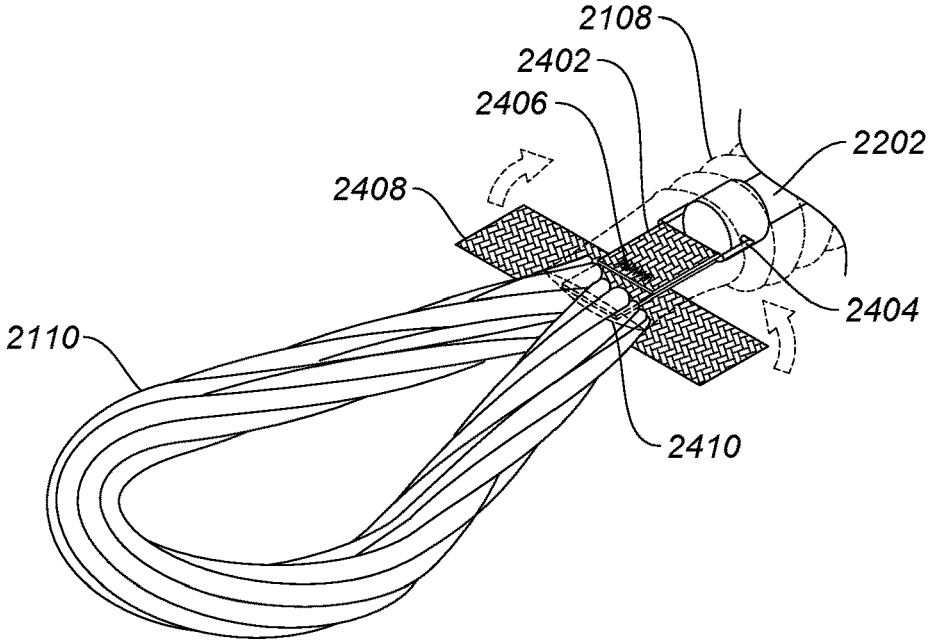
FIG. 24A is a perspective view of a connector used to connect a handle to the exercise strap of FIG. 21 according to one embodiment of the invention.

FIG. 24A is a perspective view of a connector used to connect a handle to the exercise strap of FIG. 21 according to one embodiment of the invention. As described above in connection with FIG. 21, the handle 2110 that is engage or gripped by the user is connected to the elastic exercise strap 2108. It should be appreciated that in one embodiment, the handle 2110 is loop of material that can be gripped by a user. Either embodiment described in connection with FIG. 22A/B or FIG. 23 may be used to connect the elastic inner member 2202 to a connector 2402 that is the similar or same as the connector 2106 that connects to the main buckle 106. In some embodiments, this connector 2402 is a loop made from an inelastic material, such as a nylon cloth, which may be the same material used for the connector 2106 that connects to the main buckle 106. This loop of material 2402 can be formed by connecting the ends of a length of material that is wrapped around a ring member 2404 (similar to or the same as the ring member 2210 in FIG. 22B or the ring member 2304 in FIG. 2304), to each other using stitching 2406. Another length of inelastic material or nylon cloth 2408 is then used to wrap around the connector or loop 2402 attached to the elastic inner member 2202 and around the ends 2410 of the handle 2110. The ends of this length of inelastic material 2408 are secured to each other using stitching 2412 (see FIG. 24B), thereby securing the ends 2410 of the handle 2110 and the ends of the loop 2402 attached to the elastic inner member 2202. FIG. 24A illustrates this length of inelastic material 2408 prior to being wrapped around the ends 2410 of the handle 2110 and the ends of the loop 2402 attached to the elastic inner member 2202 and prior to being secured by stitching 2412. It should be appreciated that in one embodiment, the orientation of the length of inelastic material 2408 is perpendicular to the length of loop of material 2402 connected to the ring member 2404.

Figure 24B:
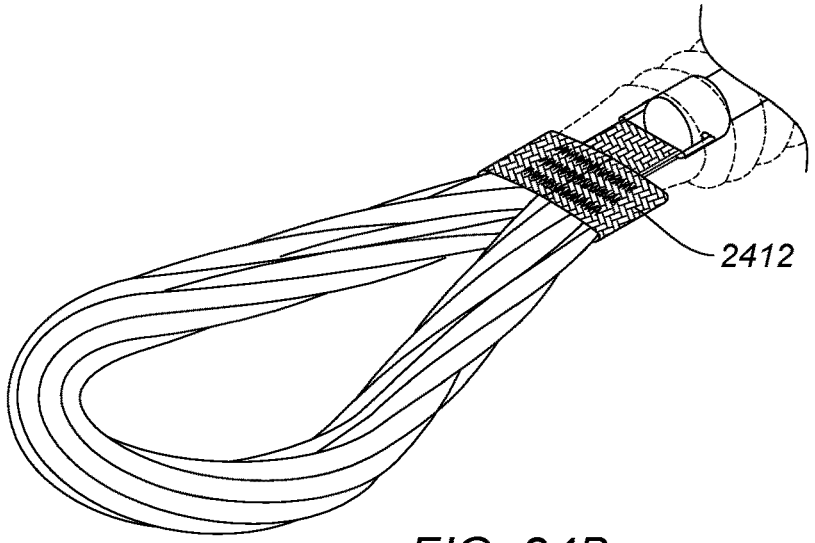
FIG. 24B is another perspective view of the connector of FIG. 24A used to connect a handle to the exercise strap of FIG. 21 according to one embodiment of the invention.

FIG. 24B is another perspective view of the connector of FIG. 24A used to connect a handle to the exercise strap of FIG. 21 according to one embodiment of the invention. FIG. 24B is the same as FIG. 24A except that it illustrates this length of inelastic material 2408 after being wrapped around the ends 2410 of the handle 2110 and the ends of the loop 2402 attached to the elastic inner member 2202 and after being secured by stitching 2412.

It should be appreciated that in some embodiments, the handle 2110 is made from a woven fabric that is soft to the touch, such as micro fiber, cotton, silk, leather, suede, or other soft material. This facilitates the grip by the user but also permits a user's skin to contact the handle 2110 directly without risking chafing or other discomfort to the skin. In some embodiments, a user may subject other parts of the user's body, such as a foot, to the handle 2110 as well with the same tactile experience due to the soft nature of the handle fabric.

Figure 24C:
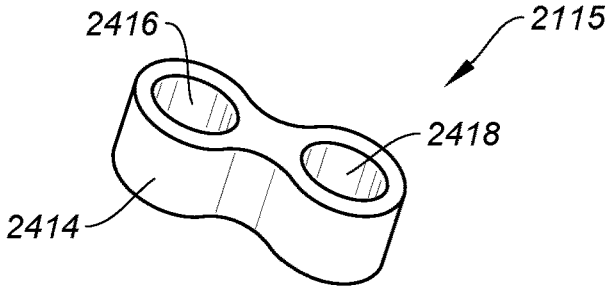
FIG. 24C is a perspective view of a handle adjuster for use with the elastic exercise straps of FIG. 21 according to one embodiment of the invention.

FIG. 24C is a perspective view of a handle adjuster for use with the elastic exercise straps of FIG. 21 according to one embodiment of the invention. With reference to FIG. 21, a handle adjuster 2115 can be attached to each handle 2110. Specifically, the handle adjuster 2115 is a single fixed body 2414 having two adjacent openings 2416, 2418 for passing the loop of material of the handle 2110 through each opening. Accordingly, the handle adjuster 2115 can slide along the handle 2110, thereby making the opening 2117 of each handle 2110 larger or smaller. For example, a user may desire a tighter grip when gripping or holding the fabric forming the handle 2110. In this case, the handle adjuster 2115 is positioned closer to the end of the handle and further away from the end 2108 of the elastic exercise strap 2102, thereby making the opening 2117 smaller and providing a tighter grip for the user. The handle adjuster 2115 can be moved closer to the end 2108 of the elastic exercise strap 2102 to form a larger opening 2117 for receipt of perhaps the user's foot for exercising. The handle adjuster 2115 can be made from any suitable material such as rubber or plastic provided such has a relatively smooth surface on the interior of the openings 2416, 2418 to facilitate sliding along the material of the handle 2110. It should be appreciated, however, that the openings are sized to provide a friction fit around the material of the handle 2110 as well such that the handle adjuster 2115 does not easily slip and will remain in place during exercise after the desired location of the handle adjuster 2115 is selected and the handle adjuster 2115 is positioned at this location.

Figure 25:
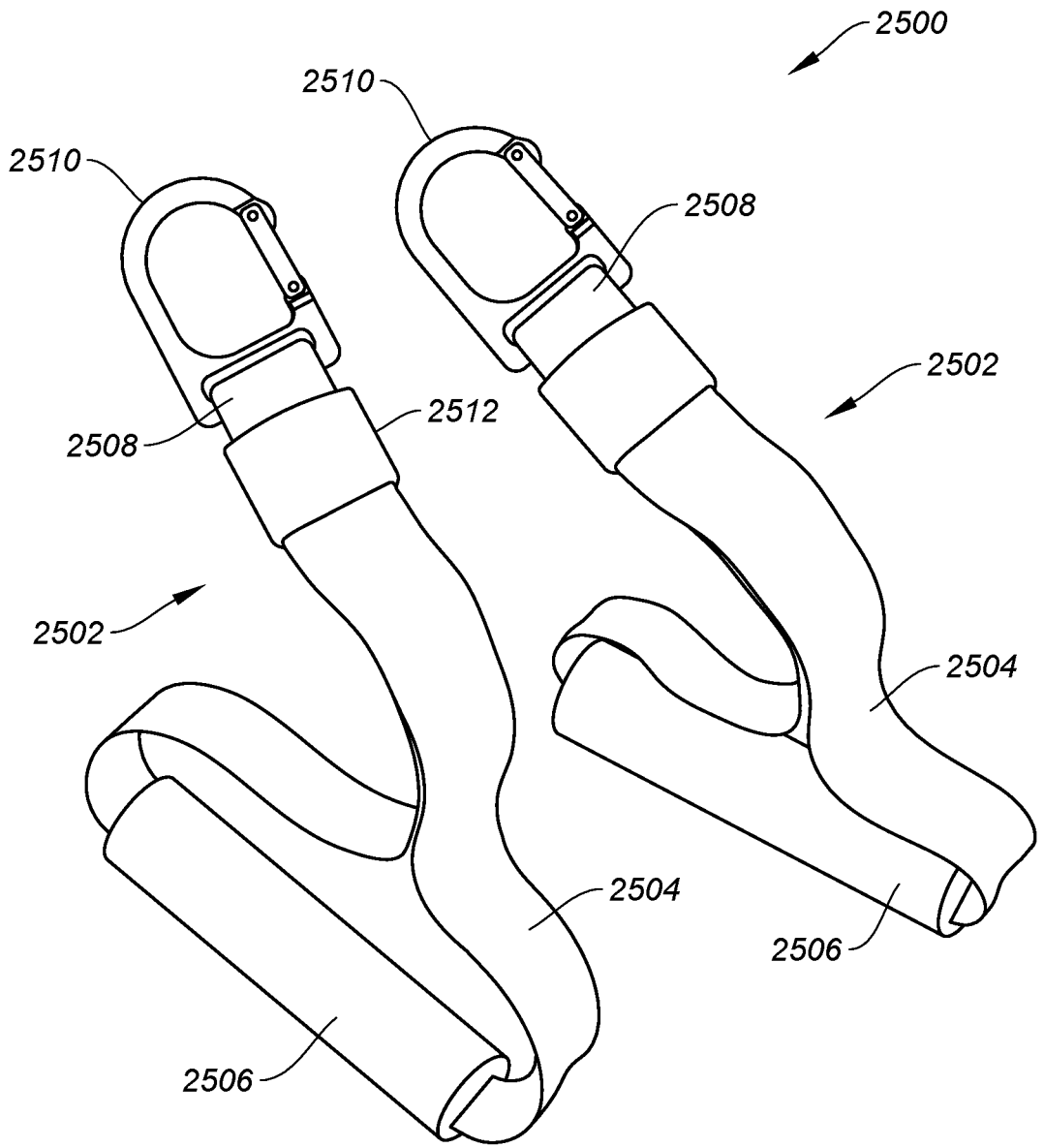
FIG. 25 is a perspective view of a pair of handles that can be used with the elastic exercise straps of FIG. 21 according to one embodiment of the invention.

FIG. 25 is a perspective view of a pair of handles that can be used with the elastic exercise straps of FIG. 21 according to one embodiment of the invention. A pair of exercise handles 2500 can be attached to the elastic exercise straps described in connection with FIG. 21 for use by a user during exercise. Each exercise handle 2502 includes a handle strap 2504 and a handle grip 2506. The construction and materials used for this exercise handle 2502 may be the similar to or the same as the handle 1816 associated with the inelastic exercise straps 1800 described above in connection with FIG. 18 with respect to the handle strap 1818 and the handle grip 1820. The ends of the handle strap 2504 are connected together thereby forming a loop 2508 at the end of the handle strap 2504 opposite from the handle grip 2506. This loop 2508 is connected to a connector 2510, which, in one embodiment, may be a carabiner. In another embodiment, the ends of the handle strap 2504 are connected to a separate piece of inelastic material that forms the loop 2508 around the connector 2510. The ends of the handle strap 2504 and the ends of this separate piece of inelastic material may be sewn together at the same location. An inelastic sleeve 2512 may be used to keep the handle strap 2504 in place near the connector 2510 or carabiner. In some embodiments, the inelastic sleeve 2512 may be stitched (not shown) to the handle strap 2504 and in some embodiments, this stitching may be used to secure the ends of the handle strap 2504 together to form the loop 2508 or the ends of the handle strap 2504 along with the ends of the separate piece of inelastic material that forms the loop 2508 around the connector 2510. With reference to FIG. 21, loops 2116 are attached to the end 2108 of each of the elastic straps 2102. These loops 2116 can be used to attach the exercise handles 2500 via the connector 2510, thereby providing the user with a different type or style of handle, in this case a solid or fixed handle, compared to the woven fabric or soft pliable handles 2110, for use during exercise. It should be appreciated that, in some embodiments, the overall length of the exercise handles 2500, or the distance between the end 2108 of the elastic exercise strap 2102 and the handle grip 2506 may be similar to or the same as the corresponding distance from the end 2108 of the elastic exercise strap 2102 to the point along the woven fabric soft handles 2110 furthest from the end 2108 of the elastic exercise strap 2102, thereby providing a similar distance from the elastic exercise strap 2102 as if the user were using the woven fabric soft handles 2110. Therefore, in this embodiment, the user would not have to move the anchor point for the elastic exercise straps 2100 if switching handles to exercise comfortably.

Figure 26:
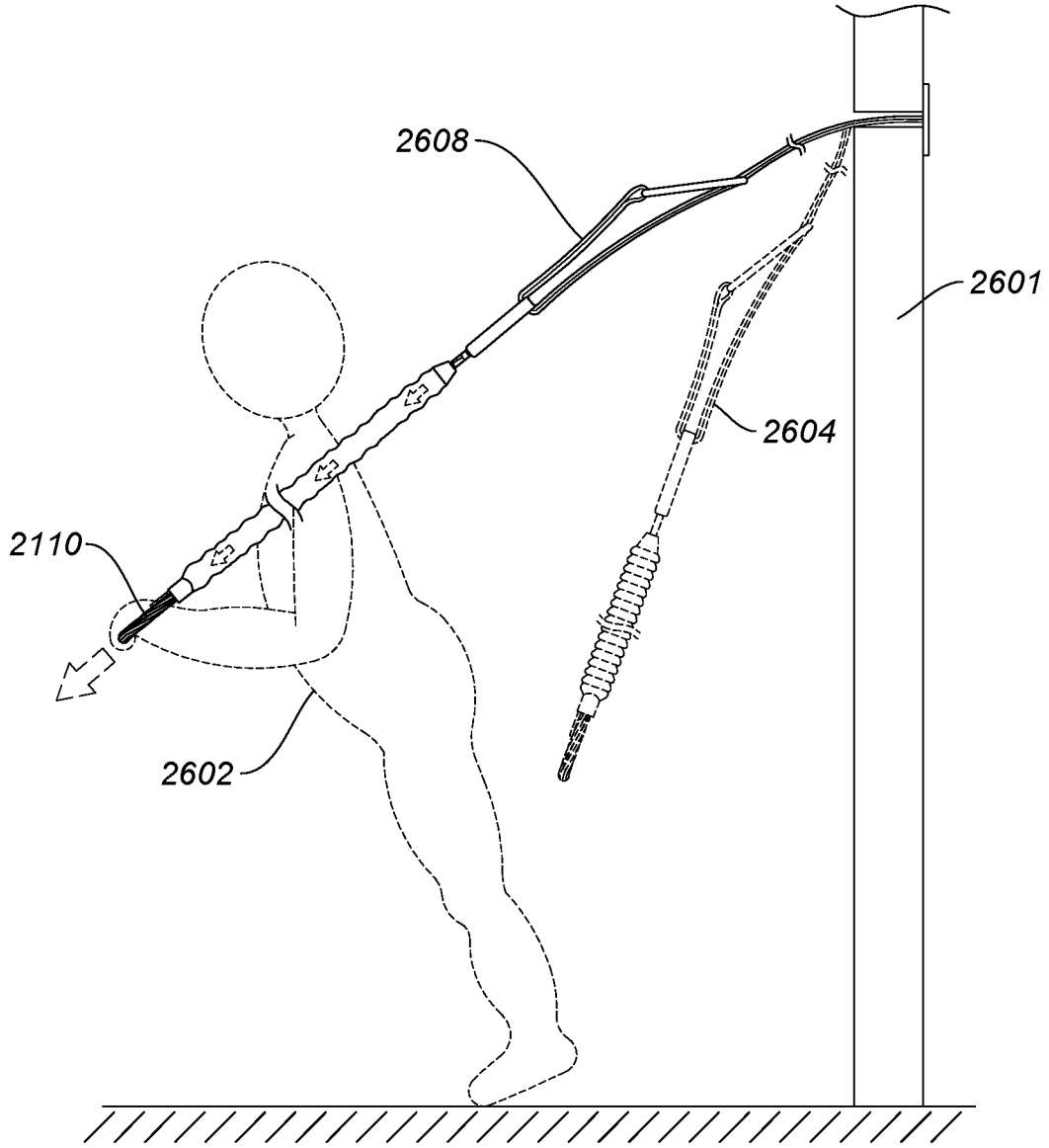
FIG. 26 is a side view of a person using the exercise system with the elastic exercise straps of FIG. 21 according to one embodiment of the invention.

FIG. 26 is a side view of a person using the exercise system with the elastic exercise straps of FIG. 21 according to one embodiment of the invention. This FIG. 26 is similar to that of FIG. 9 as far as connection of the exercise system to a stationary object, a closed door 2601 in this embodiment. However, in this embodiment, a person 2602 is using the elastic exercise straps 2100 described above in connection with FIG. 21. The elastic exercise straps 2100 are shown in a normal, un-extended position 2602 (shown by dashed lines) and, upon use by the user 2602, in an extended or stretched position 2604. In the latter position, the user 2602 is shown gripping the handles 2110 and pushing the handle grips away from the door 2601 (as shown by the arrow drawn by dashed lines), thereby stretching the elastic exercise straps 2100 away from the door 2601. The force required to pull the elastic exercise straps 2100 away from the stationary object or closed door 2601 is the exercise by the user 2602. Alternatively, the user could be facing the door 2601 and pulling the elastic exercise straps 2100 away from the door 2601. The user 2602 would then relax and the elastic exercise straps 2100 would automatically retract in a direction back toward the door 2601. Of course, other exercises that take advantage of being able to extend the elastic exercise straps 2100 can be performed. For example, some exercises that can be performed include a split kneeling wood chop, wood chop, palof press, plank should press, straight punch and upper cut, plank walk outs, bird dog, lateral raise, decline press, split kneeling row, Russian twist, bear crawls, split kneeling pulldown, and maximum intensity plank.

Figure 27:
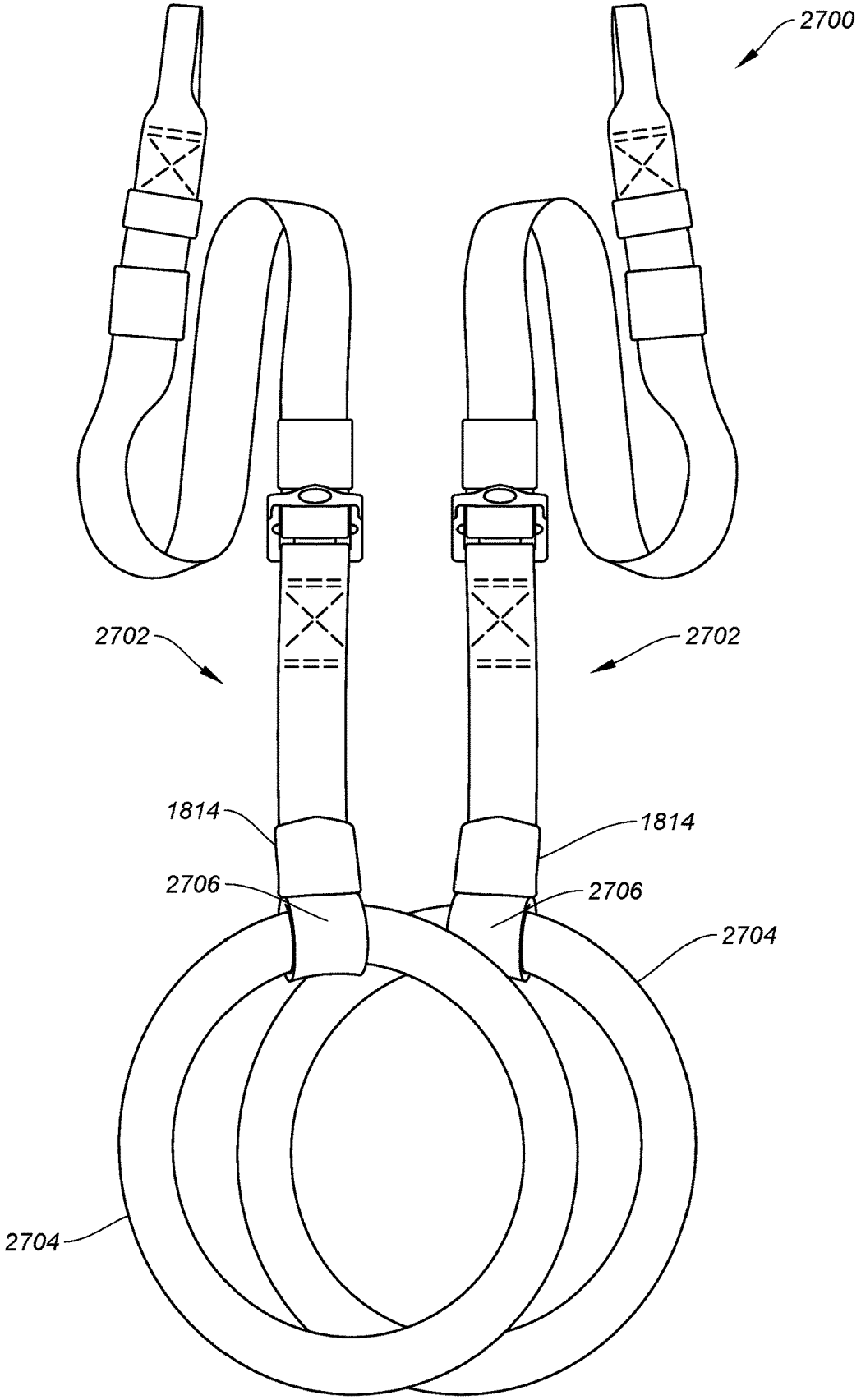
FIG. 27 is a perspective view of another pair of exercise straps with exercise rings for use with the exercise system according to one embodiment of the invention.

FIG. 27 is a perspective view of another pair of exercise straps with exercise rings for use with the exercise system according to one embodiment of the invention. The exercise straps 2700 are the same as the inelastic exercise straps 1800 as described above in connection with FIG. 18. Accordingly, all of the features described above with respect to the inelastic exercise straps 1800 as described above in connection with FIG. 18 apply equally to the exercise straps 2700, except with respect to the handles. In this embodiment, each exercise strap 2702 has a circular exercise ring 2702, such as a gymnastic ring, which allows a user to perform other types of exercise, instead of the handles 1816 as shown in FIG. 18. The gymnastic rings 2704 are attached to the ends 1814 of the lower strap 1806 by using a loop 2706 attached to the end 1814 of the lower strap 1806. The loop 2706 may be attached to the end 1814 of the lower strap 1806 by any of the connectors described above, such as those described above in connection with FIG. 22A, 22B, or 23. In one embodiment, the exercise ring 2702 is connected to a loop that is two separate lengths of inelastic material, each having a corresponding set of hook or loop fasteners or VELCO along its length and that are sewn together at their ends such that when wrapped around the gymnastic ring 2704, the lengths of material can be overlapped and the hook and loop fasteners or VELCO fasteners can be attached to each other, thereby forming a loop around the gymnastic ring 2704. A third length of inelastic material is also sewn together at its one end with the ends of the two separate lengths of inelastic material having the corresponding set of hook or loop fasteners or VELCO. This third length of inelastic material then extends away from the gymnastic ring 2704 and is sewn to a connector at the end of the exercise straps 2700. This connector can be the same combination of loops as that shown in FIG. 19C, wherein the third length of inelastic material is connected to the loops shown in the same way as the safety strap 1910. In addition, a protective sleeve similar to that shown in FIG. 28A can be disposed around the loop 2706 to minimize any irritating contact with the user's skin. Accordingly, this protective sleeve may be made from a material that is soft to the touch, such as such as micro fiber, cotton, silk, leather, suede, or other soft material. In some embodiments, the protective sleeve may be permanently sewn around the loop 2706.

Figure 28A:
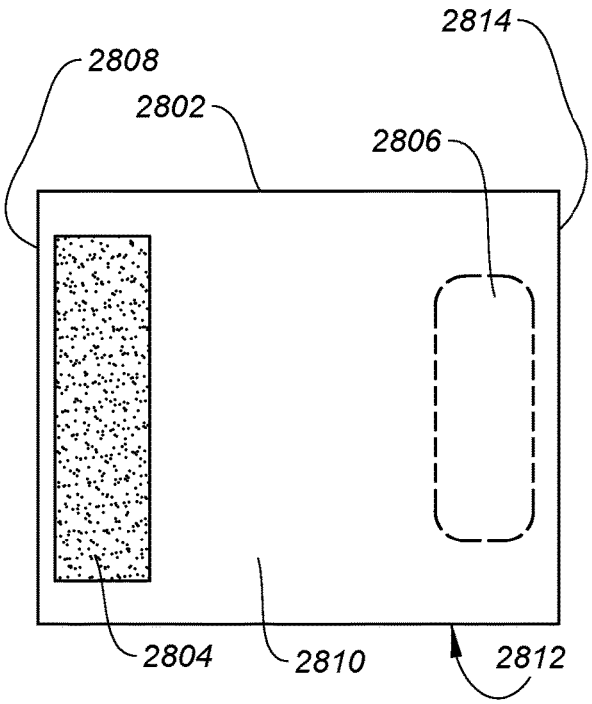
FIG. 28A is a top view of a protective sleeve for use with the exercise device of FIG. 1 according to one embodiment of the invention.

FIG. 28A is a top view of a protective sleeve for use with the exercise system of FIG. 1 according to one embodiment of the invention. The protective sleeve 2802 is a rectangular or square flat piece of material that can be used to wrap around certain portions of any of the straps used in the exercise system described herein to avoid irritation between a user's skin and that portion of the strap. The protective sleeve 2802 includes corresponding hook and loop or VELCRO fastener portions 2804, 2806. One of the hook and loop fastener portions 2804 is disposed along one side 2808 of the protective sleeve 2802 on a top surface 2810 of the protective sleeve 2802. The corresponding hook and loop fastener portions 2806 is disposed on a bottom surface 2812 along an opposite side 2814 of the protective sleeve 2802. In use, the protective sleeve 2802 can be wrapped around any portion of any strap in the exercise system such that the hook and loop fastener portions 2804, 2806 would mate and secure the protective sleeve 2808 to the strap. Accordingly, it should be appreciated that the side of the protective sleeve that faces outward after attachment to a strap is made of a soft material, such as micro fiber, cotton, silk, suede, leather, or other soft material that is soft to a human touch and that would minimize any irritation, burn, or chaffing experienced as a result of the user's skin rubbing against the strap at that particular point.

Figure 28B:
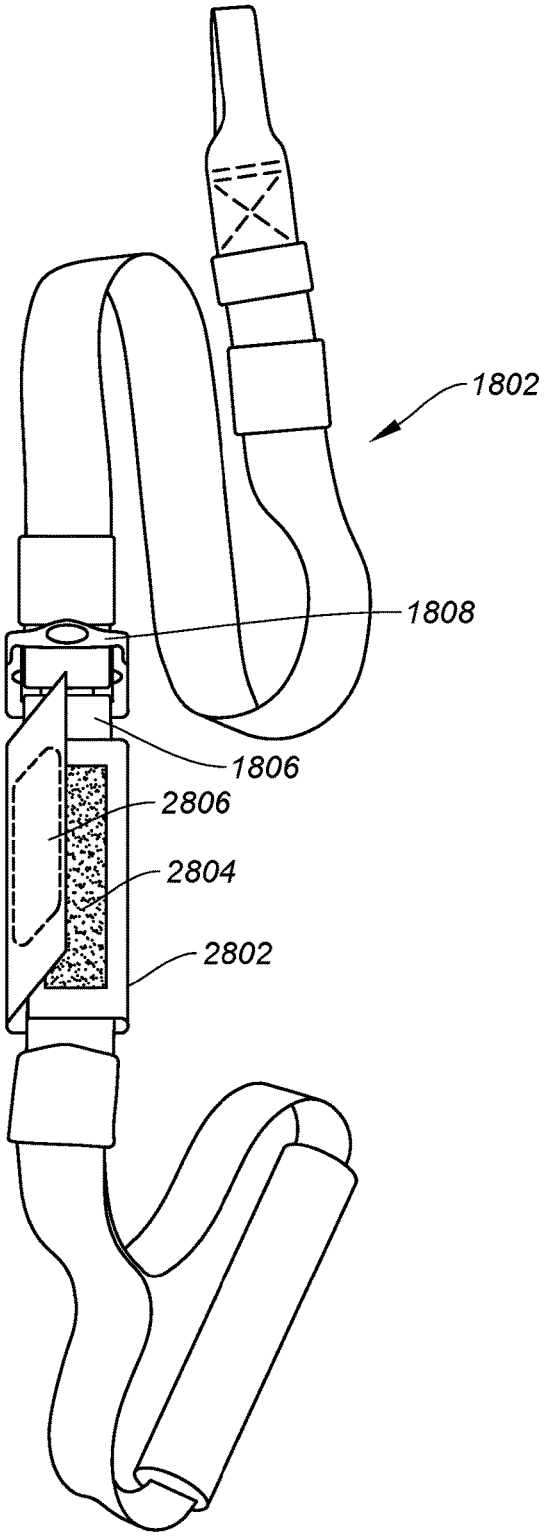
FIG. 28B is a top perspective view of the protective sleeve of FIG. 28A disposed about an exercise strap according to one embodiment of the invention.

FIG. 28B is a top perspective view of the protective sleeve of FIG. 28A disposed about an exercise strap according to one embodiment of the invention. Inelastic exercise strap 1802 is shown with the protective sleeve 2802 being placed along a portion of the lower exercise strap 1806 (i.e., below the strap buckle 1808, see FIG. 18). As shown, the protective sleeve 2802 is wrapped around the exercise strap 1806, and the corresponding hook and loop fastener portions 2804, 2806 would connect with each other, thereby securing the protective sleeve to the exercise strap 1806. It should be appreciated that the hook and loop fastener portions 2804, 2806 would be on the interior of the protective sleeve 2802 and only the soft material on the side of the protective sleeve facing outward (the bottom side 2812 in this particular embodiment, as shown by the arrow to indicate the underside) would be exposed. Therefore, any contact between the user's skin and this portion of the strap would be against the soft exposed material of the protective sleeve 2802. It should be appreciated that while the protective sleeve 2802 is shown in use with the lower strap 1806 of the inelastic straps 1800 of FIG. 18, the protective sleeve 2802 can be used with any strap or any portion of the exercise system to minimize irritation with a user's skin.

Figure 29A:
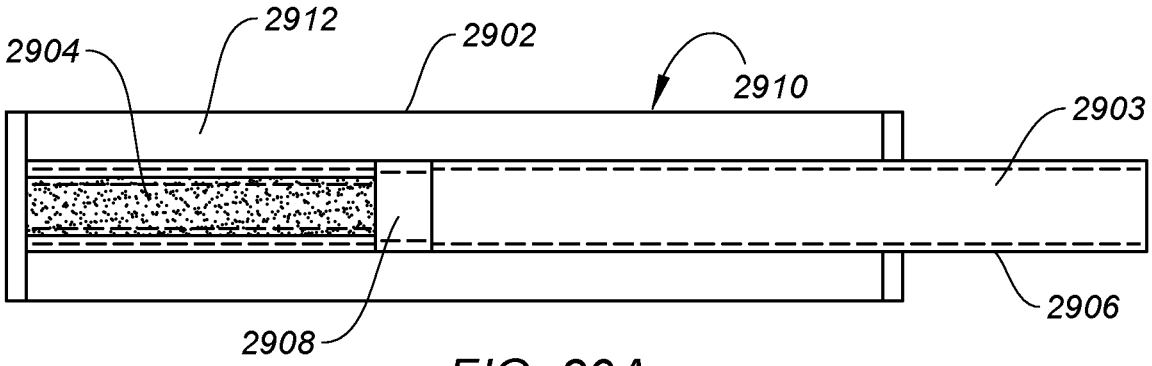
FIG. 29A is a top view of a wrist strap for use with the exercise device of FIG. 1 according to one embodiment of the invention.

FIG. 29A is a top view of a wrist strap for use with the exercise device of FIG. 1 according to one embodiment of the invention. A wrist strap 2902 is shown in an opened flat position. The wrist strap is a rectangular flat piece of material that can be formed into a cylindrical piece of material and connected to an exercise strap of the exercise system and used to insert or hold a user's wrist during exercise. In other words, a user may use the wrist strap 2902 instead of a handle on an exercise strap to exercise. The wrist strap 2902 includes a tab 2903 extending from the wrist strap and corresponding hook and loop portions 2904, 2906 located respectively on the wrist strap 2902 and on the underside or bottom side of the tab 2903. The wrist strap also includes a loop of material 2908 that extends outwardly from the wrist strap 2902 for connection to the exercise system. It should be appreciated that this loop 2908 can be attached to the wrist strap in any manner, such as stitching, that provides a sufficient attachment to withstand the forces to which it will be subjected during exercise, such as a given user's weight. It should be appreciated that the bottom side 2910 (i.e., the side opposite the top side 2912 and as shown by the arrow to indicate the underside) of the wrist strap 2902 can be made from a material that is soft to a human touch, such micro fiber, cotton, silk, suede, leather, or other soft material, and that would minimize any irritation, burn, or chaffing experienced as a result of contact with the user's wrist during exercise. It should also be appreciated that the user may use the wrist strap with the user's foot as well.

Figure 29B:
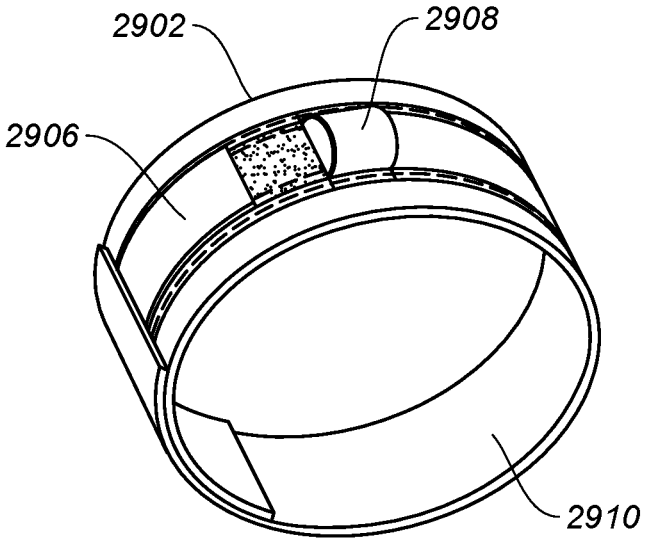
FIG. 29B is a perspective view of the wrist strap of FIG. 29A in a closed position according to one embodiment of the invention.

FIG. 29B is a perspective view of the wrist strap of FIG. 29A in a closed position according to one embodiment of the invention. In use, the wrist strap 2902 is formed into a cylinder by mating the hook and loop fastener portions 2904 and 2906 against each other. When the wrist strap 2902 is formed into a cylinder, the hook and loop portion 2906 on the underside of the tab 2903 can be attached to the corresponding hook and loop portion 2904 on the wrist strap 2902 at the opposite end, thereby bring the two ends of the wrist strap 2902 together in a cylinder. It should be appreciated that the two ends of the wrist strap 2902 can be overlapped in varying amounts as necessary to provide the appropriate diameter for use of the wrist strap 2902 by the user, provided that there is sufficient overlap of the hook and loop fastener portions 2904, 2906 to make a secure connection between these ends. As shown, the bottom side 2910 of the wrist strap 2902 is the internal surface of the wrist strap 2902 that would be exposed to the user's wrist or foot. Accordingly, the soft material used for this bottom side 2910 minimizes or prevents any irritation to the user's skin. The loop 2908 can be attached to, for example, a loop 2116 at the end of the elastic exercise strap 2102 as shown in FIG. 21. Accordingly, instead of using the handle 2110, a user may exercise using the wrist strap 2902 or a pair of wrist straps 2902. A metal hook or carabiner or other connector (see the connector 2510 in FIG. 25 that is used to connect the handles 2500 to the loop 2116 at the end of the elastic exercise strap 2102) may be used to facilitate the connection between the loop 2908 of the wrist strap 2902 and the loop 2116 of the elastic exercise strap 2102.

Figure 30A:
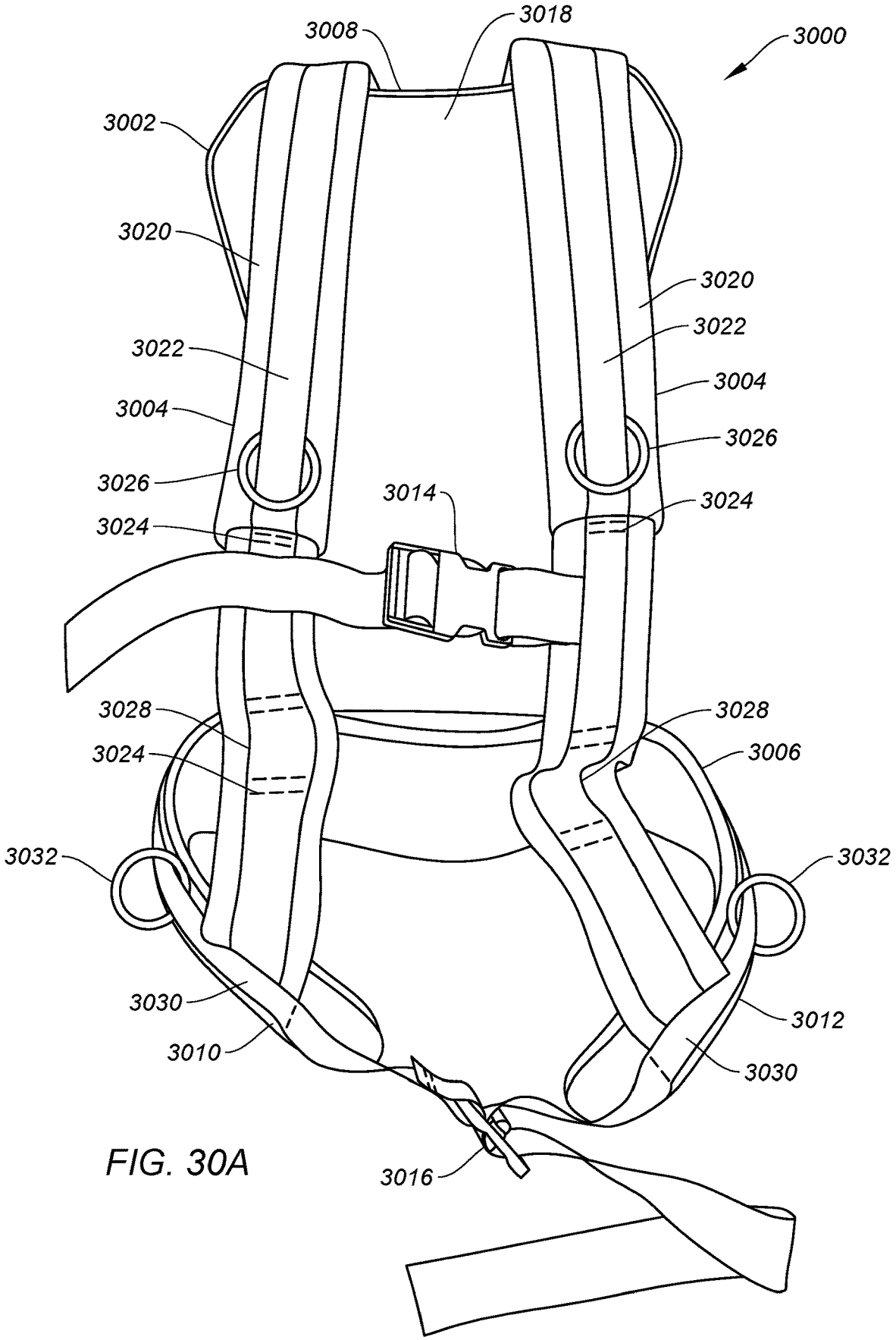
FIG. 30A is a perspective front view of a vest for use with the exercise system of FIG. 1 according to one embodiment of the invention.

FIG. 30A is a perspective front view of a vest for use with the exercise system of FIG. 1 according to one embodiment of the invention. A vest 3000 can be worn by a user and can be connected to the exercise system of FIG. 1 for use in exercising. The vest 3000 has a back panel 3002, a pair of shoulder straps 3004, and a waist belt 3006. The shoulder straps 3004 are looped over one side of the top 3008 of the back panel 3002 and attached to the back panel 3002 (see FIG. 30B) and at the other opposite end are attached to a corresponding end 3010, 3012 of the waist belt 3006. In use, the user would place the vest around their torso. The user's arms would be placed between the back panel 3002 and the shoulder straps 3004 such that the shoulder straps 3004 would rest on top of the user's shoulders near the top 3008 of the back panel, which would rest against the user's back. The shoulder straps are connected to a chest buckle 3014 that secures the shoulder straps 3004 across the user's chest and can be used to adjust the fit of the vest 3000 around the user's chest by adjusting the distance between the shoulder straps 3004 across the user's chest. The chest buckle 3014 can also be disconnected to release each of the shoulder straps 3004 from each other at this location. The waist belt 3006 also includes a waist buckle 3016 to connect the two ends 3010, 3012 of the waist belt 3006 around the user's waist and to tighten or adjust the fit of the waist belt 3006 around the user's waist. The waist buckle 3016 can also be disconnected to release the ends 3010, 3012 of the waist belt 3006 from each other to facilitate removal of the vest 3000 from the user's torso.

The back panel 3002, the shoulder straps 3004, and the waist belt 3006 may be made from any suitable material, including any type of cloth material that will withstand the force exerted across the vest during use in exercising. The inside 3018 of the back panel 3002, as well as the inside of the waist belt 3006, may include a material, either as part of the back panel 3002 itself or as a separate layer of material, that wicks water or perspiration from the user's back during exercise or otherwise acts to ventilate the space between the user's back and the back panel 3002 of the vest 3000. In one embodiment, this material is a mesh material. The material used to connect the chest buckle 3014 and the waist buckle 3016 to the respective portions of the shoulder straps 3004 and the ends 3010, 3012 of the waist belt 3006, can similarly be any suitable material, including any type of cloth material that will withstand the force exerted across the vest during use in exercising, such as an inelastic nylon material. The chest buckle 3014 and the waist buckle 3016 may be any buckle having the ability to adjust the length of a strap to which it is connected and having a strength suitable to withstand the force exerted across the vest during use in exercising, including a plastic buckle.

The shoulder straps 3004 may have a protective sleeve 3020 that extends along the length or a portion of the length of the shoulder straps 3004 to minimize irritation or discomfort when worn. Accordingly, the protective sleeve 3020 may be made from a soft materials as described in connection with the protective sleeve 2802 of FIG. 28A. The protective sleeve 3020 may be a length of material having corresponding hook and loop fasteners or VELCO fasteners along one side of its length or at certain locations along its length that allows the protective sleeve 3020 to be wrapped around the shoulder strap 3002 and secured using the fasteners in a manner similar to the protective sleeve 2802 described in connection with FIG. 28A. This allows the protective sleeve 3020 to also be removed for convenience, such as for cleaning. The protective sleeve 3020 may also have padding embedded with the material used for the protective sleeve 3020, such as foam padding. It should be appreciated that in one embodiment, the padding is positioned within the protective sleeve 3020 such that it extends along the length of the protective sleeve 3020 on the side that rests directly against a user's shoulders. In one embodiment, the protective sleeve 3020 only extends along that portion of the length of the shoulder straps 3004 that contacts a user's shoulder when worn.

The shoulder straps 3004 may also each have a top strap 3022 that is attached to the back of the back panel 3002 (see FIG. 30B) and looped over the top 3008 of the back panel parallel to the shoulder strap 3004 and extends along the entire length of the shoulder straps 3004. This top strap 3022 may be similarly made from any suitable material, including any type of cloth material that will withstand the force exerted across the vest during use in exercising, including an inelastic nylon material. This top strap 3022 may be attached to the shoulder straps using stitching 3024. In one embodiment, the top strap 3022 is not attached to the shoulder strap 3004 along a certain length of the top strap 3022 or shoulder strap 3004, which in one embodiment may be the length of the top strap 3022 extending from the back panel 3002 to a predetermined location along the length of the shoulder strap 3004, such as a middle location along the length of the shoulder strap 3004. In this case, the top strap 3022 is attached to the shoulder strap 3004 only at locations between this predetermined location and the location where the shoulder strap 3004 is attached to the waist belt 3006, such as by the locations of the stitchings 3024 as shown in FIG. 30A. In this embodiment, a ring 3026, such as a metal ring, may be disposed about the top strap 3022 and free to slide along the portion of the top strap 3022 that is not attached to the shoulder strap 3004. In addition, the top strap 3022 may have a length that is longer than the shoulder strap 3004 such that when stitched to the shoulder strap 3004, one or more loops 3028 can be created. The ring 3026 and the loop 3028 can be used to connect the vest to the exercise system as described further below. It should be appreciated that the top strap 3022 can extend along the entire length of the shoulder strap 3004 and be attached, with the shoulder strap 3004, to the waist belt 3006.

The waist belt 3006 may similarly have a top strap 3030 that extends along the length of the waist belt 3006. Also, similarly, the length of the top strap 3030 may be stitched at various locations to provide a loop between the top strap 3030 and the waist belt 3006. Rings 3032, such as metal rings, may be similarly attached to these loops for use in connecting the vest to the exercise system as described further below.

Figure 30B:
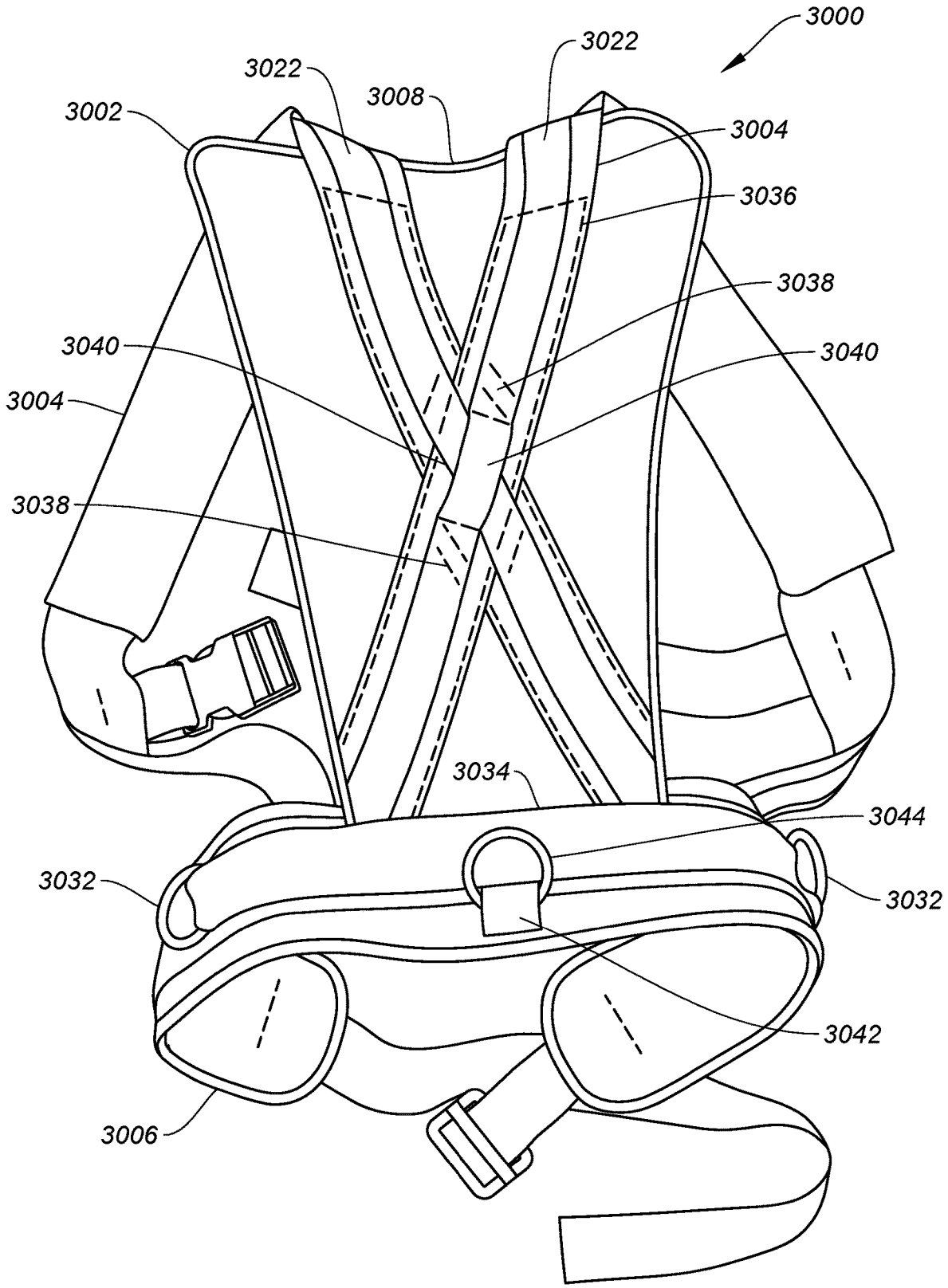
FIG. 30B is a perspective rear view of the vest of FIG. 30A for use with the exercise system of FIG. 1 according to one embodiment of the invention.

FIG. 30B is a perspective rear view of the vest of FIG. 30A for use with the exercise system of FIG. 1 according to one embodiment of the invention. The back panel 3002 is used to secure the shoulder straps 3004 to the vest 3000. The shoulder straps 3004 extend across the back of the back panel from one side of the top side 3008 of the vest 3000 diagonally across the back panel 3002, such that they crisscross at approximately the middle of the back panel 3002, and are attached at their respective ends to the opposite side of the bottom 3034 of the back panel 3002. The shoulder straps 3004 are stitched to the back panel 3002 using stitchings 3036 along the entire perimeter of the shoulder straps 3004 that are adjacent to the back panel 3002. The top straps 3022 extend along the entire length of the shoulder straps 3002 and may similarly be attached to the shoulder straps 3004 using stitchings 3038, which may be done at various locations along the top straps 3022. Accordingly, the top straps 3022 also crisscross at approximately the center of the back panel 3002. At this location, the top straps 3022 are stitched to allow for the formation of a pair of loops 3040 between the top strap 3022 and the corresponding shoulder strap 3004. As shown, one of these loops 3040 is inherently underneath the other loop 3040. In addition, a loop 3042 is attached to the top strap 3030 and the waist belt 3006 at approximately the center of the length of the waist belt 3006 in the back of the vest 3000. A ring 3044, such as a metal ring, may be attached to this loop. As discussed below, these loops 3040 and the ring 3044 may also be used to connect the vest 3000 to the exercise system.

Generally, it should be appreciated that the various loops 3028 and rings 3026, 3032, 3044 can be attached as desired by a user to the exercise system. In one embodiment, the loops 3028 or rings 3026, 3032, 3044 can be attached to the loops 2116 on the elastic exercise straps 2100 as described in connection with FIG. 21. In this manner, the user may connect each side of the vest 3000 using corresponding loops 3028 or rings 3026, 3032, 3044 to one of the elastic exercise straps 2102 for exercising. With respect to the connection of the loops 3028 to the loops 2116 on the elastic exercise straps 2100, a separate metal hook or carabiner or other connector (see the connector 2510 in FIG. 25 that is used to connect the handles 2500 to the loop 2116 at the end of the elastic exercise strap 2102) may be used to facilitate this connection.

Various embodiments of the invention have been described above. However, it should be appreciated that alternative embodiments are possible and that the invention is not limited to the specific embodiments described above. For example, stitching is used in various embodiments to attach various components to each other. It should be appreciated that alternative methods of attaching the types of materials used in the exercise system may be used such as gluing or fusing the material together, provided that such provides a sufficiently strong connection to withstand the force exerted on that connection during use or exercise. Additional, many materials may be used for the various components of the system, including the various elastic and inelastic materials, provided that such have the necessary strength, such as tensile strength, to withstand the force exerted on that connection during use or exercise. For example, various cloth or cloth-type materials may be used, including cotton, canvas, or plastic-based or nylon materials. In addition, various components of the exercise system, including the main buckle, as well as other buckles and carabiners, can be made from a variety of materials, including a variety of metals, provided such have sufficient strength to withstand forces applied to them during use. In some embodiments, these metal components may be made from aluminum, such as 7075 Aluminum. Further, while various exercises have been noted, it should be appreciated that a user may use the exercise system for a wide variety of exercises, particularly in conjunction with the variety of optional equipment that can be attached to the exercise system for use. Accordingly, it should be appreciated that other optional equipment may also be designed for attachment to the various parts of the exercise system.

What is claimed is:

1. An exercise system, comprising:

a main strap having a length, a first end configured for attachment to a stationary object, and an opposite second end configured for attachment to a first location along the length of said main strap, thereby forming a loop upon attachment to said first location;

a connector having a single body attached to said loop of said main strap and defining two separate openings;

a pair of exercise straps, each having a first end configured for attachment to one of said two separate openings of said connector and a second end opposite said first end; and a pair of handles, each attached to one of said second ends of said exercise straps, wherein said connector is configured to freely slide along said main strap within said loop.

2. An exercise system, comprising:

a main strap having a length, a first end configured for attachment to a stationary object, and an opposite second end configured for attachment to a first location along the length of said main strap, thereby forming a loop upon attachment to said first location;

a connector having a single body attached to said loop of said main strap and defining two separate openings;

a pair of exercise straps, each having a first end configured for attachment to one of said two separate openings of said connector and a second end opposite said first end; and a pair of handles, each attached to one of said second ends of said exercise straps, wherein said first end of said main strap comprises a loop, and further comprising:

a body configured to attach to said loop, said body having a center cylindrical portion having a pair of opposite ends and a pair of cylindrical bodies, each attached to one of said opposite ends of said center cylindrical portion, wherein said cylindrical bodies have a diameter larger than a diameter of said center cylindrical portion and a length less than a length of said center cylindrical portion; and a pair of non-slip pads disposed around an outside surface of each of the cylindrical bodies.

3. The exercise system of claim 2, wherein at least one of said cylindrical bodies is configured to be reversibly attached and detached from one of said opposite ends of said center cylindrical portion.

4. An exercise system, comprising:

a main strap having a length, a first end configured for attachment to a stationary object, and an opposite second end configured for attachment to a first location along the length of said main strap, thereby forming a loop upon attachment to said first location;

a connector having a single body attached to said loop of said main strap and defining two separate openings;

a pair of exercise straps, each having a first end configured for attachment to one of said two separate openings of said connector and a second end opposite said first end; and a pair of handles, each attached to one of said second ends of said exercise straps, wherein said pair of exercise straps comprises a pair of inelastic exercise straps, wherein a length of each of said inelastic exercise straps is adjustable, wherein each of said exercise straps comprises a first strap, a second strap, a buckle for connecting said first strap and said second strap and for adjusting the length of said first strap, and a sleeve disposed along said first strap and through which said first strap passes, and further comprising:

a pair of safety straps, each having a first end attached to said second strap and a second end opposite said first end attached to said sleeve.

5. An exercise system, comprising:

a main strap having a length and a first end configured for attachment to a first location along the length of said first strap, thereby forming a loop sufficient to encompass a stationary object upon attachment to said first location, and a second end opposite said first end;

a connector attached to said second end of said main strap and having two separate openings;

a pair of exercise straps, each having a first end configured for attachment to one of said two separate openings of said connector and a second end opposite said first end; and a pair of handles, each attached to one of said second ends of said exercise straps, wherein said first end of said main strap comprises a loop, and further comprising:

a body configured to attach to said loop, said body having a center cylindrical portion having a pair of opposite ends and a pair of cylindrical bodies, each attached to one of said opposite ends of said center cylindrical portion, wherein said cylindrical bodies have a diameter larger than a diameter of said center cylindrical portion and a length less than a length of said center cylindrical portion; and a pair of non-slip pads disposed around an outside surface of each of the cylindrical bodies.

6. The exercise system of claim 5, wherein at least one of said cylindrical bodies is configured to be reversibly attached and detached from one of said opposite ends of said center cylindrical portion.

7. The exercise system of claim 5, wherein said pair of exercise straps comprises a pair of inelastic exercise straps, wherein a length of each of said inelastic exercise straps is adjustable, wherein each of said exercise straps comprises a first strap, a second strap, a buckle for connecting said first strap and said second strap and for adjusting the length of said first strap, and a sleeve disposed along said first strap and through which said first strap passes, and further comprising:

a pair of safety straps, each having a first end attached to said second strap and a second end opposite said first end attached to said sleeve.

* * * * *